US009592684B2

(12) United States Patent
Sasaki et al.

(10) Patent No.: US 9,592,684 B2
(45) Date of Patent: Mar. 14, 2017

(54) RECORDING APPARATUS AND RECORDING METHOD

(71) Applicant: SEIKO EPSON CORPORATION, Tokyo (JP)

(72) Inventors: Tsuneyuki Sasaki, Matsumoto (JP); Mayu Arai, Matsumoto (JP); Junya Kato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/962,319

(22) Filed: Dec. 8, 2015

(65) Prior Publication Data

US 2016/0167408 A1 Jun. 16, 2016

(30) Foreign Application Priority Data

Dec. 11, 2014 (JP) ..... 2014-250621
Dec. 11, 2014 (JP) ..... 2014-250628

(51) Int. Cl.

| | |
|---|---|
| ***B41J 15/04*** | (2006.01) |
| ***B41J 11/00*** | (2006.01) |
| ***B65H 9/10*** | (2006.01) |
| ***B65H 18/00*** | (2006.01) |

(52) U.S. Cl.
CPC ..... *B41J 15/046* (2013.01); *B41J 11/0095* (2013.01); *B41J 15/04* (2013.01); *B65H 9/103* (2013.01); *B65H 18/00* (2013.01)

(58) Field of Classification Search
CPC ..... B65H 9/106; B41J 15/046
See application file for complete search history.

(56) References Cited

U.S. PATENT DOCUMENTS

| | | | | |
|---|---|---|---|---|
| 5,947,617 | A | 9/1999 | Kondo | |
| 2002/0134880 | A1* | 9/2002 | Tomura | B65H 18/26 242/547 |
| 2013/0277482 | A1* | 10/2013 | Naramatsu | B65H 23/063 242/334 |
| 2014/0197267 | A1* | 7/2014 | Sasaki | B65H 23/032 242/548 |

FOREIGN PATENT DOCUMENTS

| | | | |
|---|---|---|---|
| JP | 63-171749 | A | 7/1988 |
| JP | 04-169259 | A | 6/1992 |
| JP | 07-009858 | U | 2/1995 |
| JP | 09-300883 | A | 11/1997 |
| JP | 10-129896 | A | 5/1998 |
| JP | 2003-128307 | A | 5/2003 |
| JP | 2013-107713 | A | 6/2013 |

* cited by examiner

*Primary Examiner* — Shelby Fidler
(74) *Attorney, Agent, or Firm* — Workman Nydegger

(57) ABSTRACT

Provided is a recording apparatus including a transporting unit capable of transporting a medium, a detecting unit capable of detecting a transport direction in which the medium is transported by the transporting unit, a recording unit capable of performing recording on the medium transported by the transporting unit, and a member capable of coming into contact with and separating from a side of the medium opposite to a recording side on which recording is performed by the recording unit and coming into contact with at least a part of the opposite side of the medium to prevent skewing of the transported medium when the medium is transported by the transporting unit.

6 Claims, 26 Drawing Sheets

RECORDING APPARATUS AND RECORDING METHOD

BACKGROUND

1. Technical Field

Embodiments of the present invention relate to a recording apparatus and a recording method.

2. Related Art

A recording apparatus transporting a medium to perform recording on the transported medium is employed in the related art. In such a recording apparatus, when the medium is skewed during transport thereof, the quality of recorded images may be degraded, or creases may be produced on the medium to cause the medium to come into contact with a recording unit, in which case the recorded images, the medium, and the recording unit may be damaged. Thus, there is disclosed a technology to prevent skewing of the transported medium.

For example, in JP-A-4-169259, there is disclosed a skew correction device including a guide roller capable of moving while maintaining contact with a medium.

In addition, for example, in JP-A-2013-107713, there is disclosed a transporting device including a pair of skew correction rollers that includes a roller on which contact regions having different coefficients of friction against a medium are disposed.

The skew correction device of JP-A-4-169259 is configured to prevent skewing of a transported medium by moving the guide roller, which is capable of moving while maintaining contact with the medium, to exert heavy load on the continuous medium such as a roll-shaped medium. In such a configuration, even though it is easy to roughly correct significant skewing of the transported medium, slight skewing of the transported medium may be difficult to correct accurately. In addition, since heavy load is exerted on the medium in the configuration, only a continuous medium such as a roll-shaped medium can be employed, and types of usable media are limited.

In the transporting device of JP-A-2013-107713, the upper roller of the pair of skew correction rollers is configured to come into contact with the upper side of the medium. Thus, when the transporting device is employed in a recording apparatus, the roller comes into contact with the recording side of the medium, thereby possibly damaging the recording side. In addition, since the configuration of the transporting device is assumed to correct skewing of a cut medium transported, the configuration cannot be employed with a continuous medium such as a roll-shaped medium, thereby limiting types of usable media.

As such, it may be difficult to prevent skewing of a transported medium in the recording apparatus of the related art transporting a medium to perform recording on the transported medium.

SUMMARY

An advantage of some aspects of the invention is to prevent skewing of a transported medium.

According to an aspect of the invention, there is provided a recording apparatus including a transporting unit that is capable of transporting a medium, a detecting unit that is capable of detecting a transport direction in which the medium is transported by the transporting unit, a recording unit that is capable of performing recording on the medium transported by the transporting unit, a frictional force exerting unit that is capable of coming into contact with and separating from a side of the medium opposite to a recording side on which recording is performed by the recording unit and is capable of coming into contact with at least a part of the opposite side of the medium to exert frictional force on the medium when the medium is transported by the transporting unit, and a control unit that controls the contact of the frictional force exerting unit with the medium on the basis of a detection result from the detecting unit.

According to another aspect of the invention, there is provided a recording apparatus including a transporting unit that is capable of transporting a medium, a detecting unit that is capable of detecting a transport direction in which the medium is transported by the transporting unit, a recording unit that is capable of performing recording on the medium transported by the transporting unit, a rotating object that includes a contactable region having a coefficient of friction against the medium increasing from one side to the other side of the rotating object in an intersecting direction intersecting with the transport direction as well as a contactable region having a coefficient of friction against the medium decreasing from the one side to the other side and is capable of coming into contact with a side of the medium opposite to a recording side on which recording is performed by the recording unit while including a rotating shaft in the intersecting direction, and a control unit that controls the rotating object on the basis of a detection result from the detecting unit to change a region of the rotating object coming into contact with the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus according to one embodiment of the invention will be described in detail with reference to the appended drawings.

First Embodiment

FIG. 1 to FIG. 9B

Figure 1:
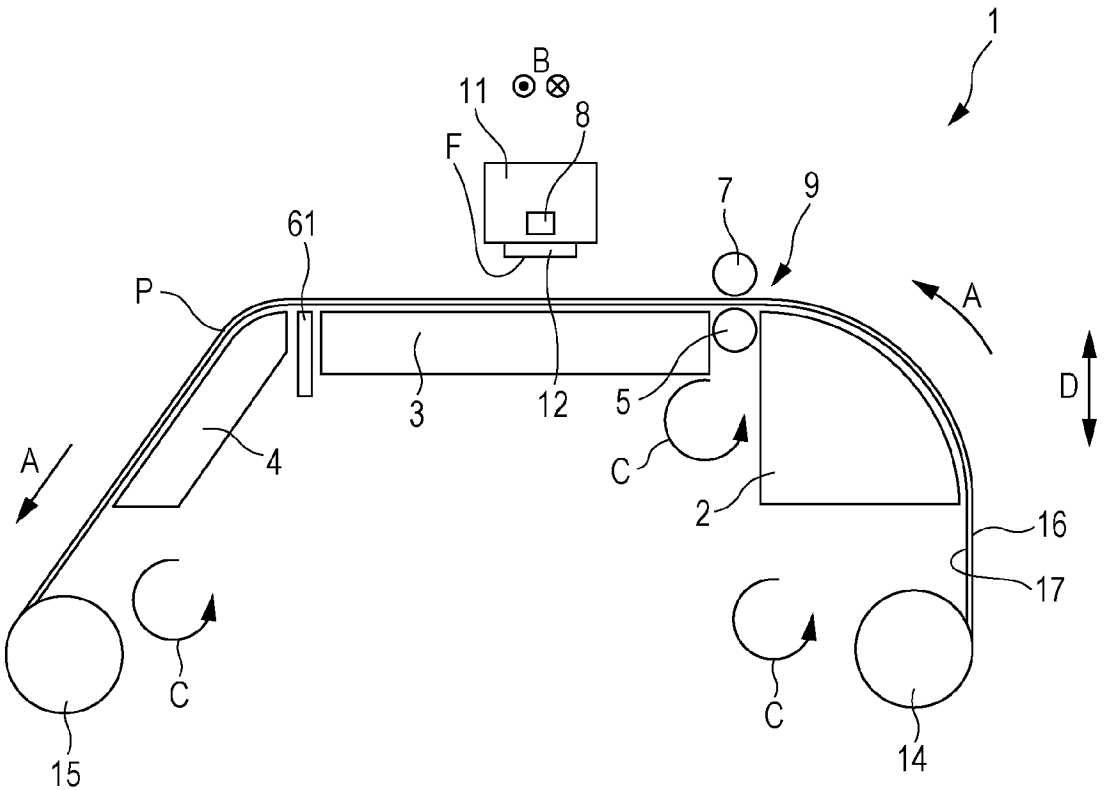
FIG. 1 is a schematic side view illustrating a recording apparatus according to a first embodiment of the invention.
Figure 2:
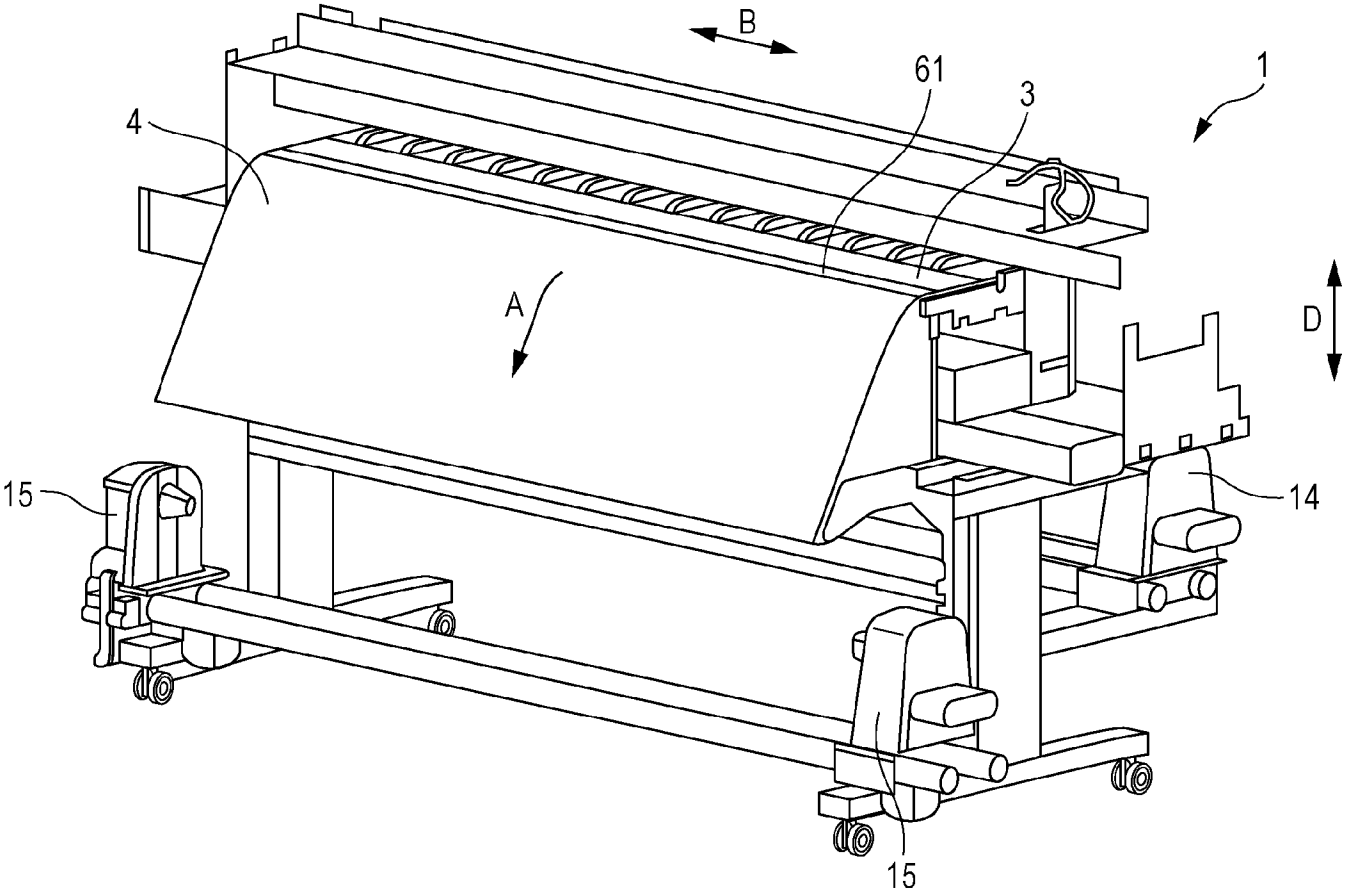
FIG. 2 is a schematic perspective view illustrating the recording apparatus according to the first embodiment of the invention.
Figure 3:
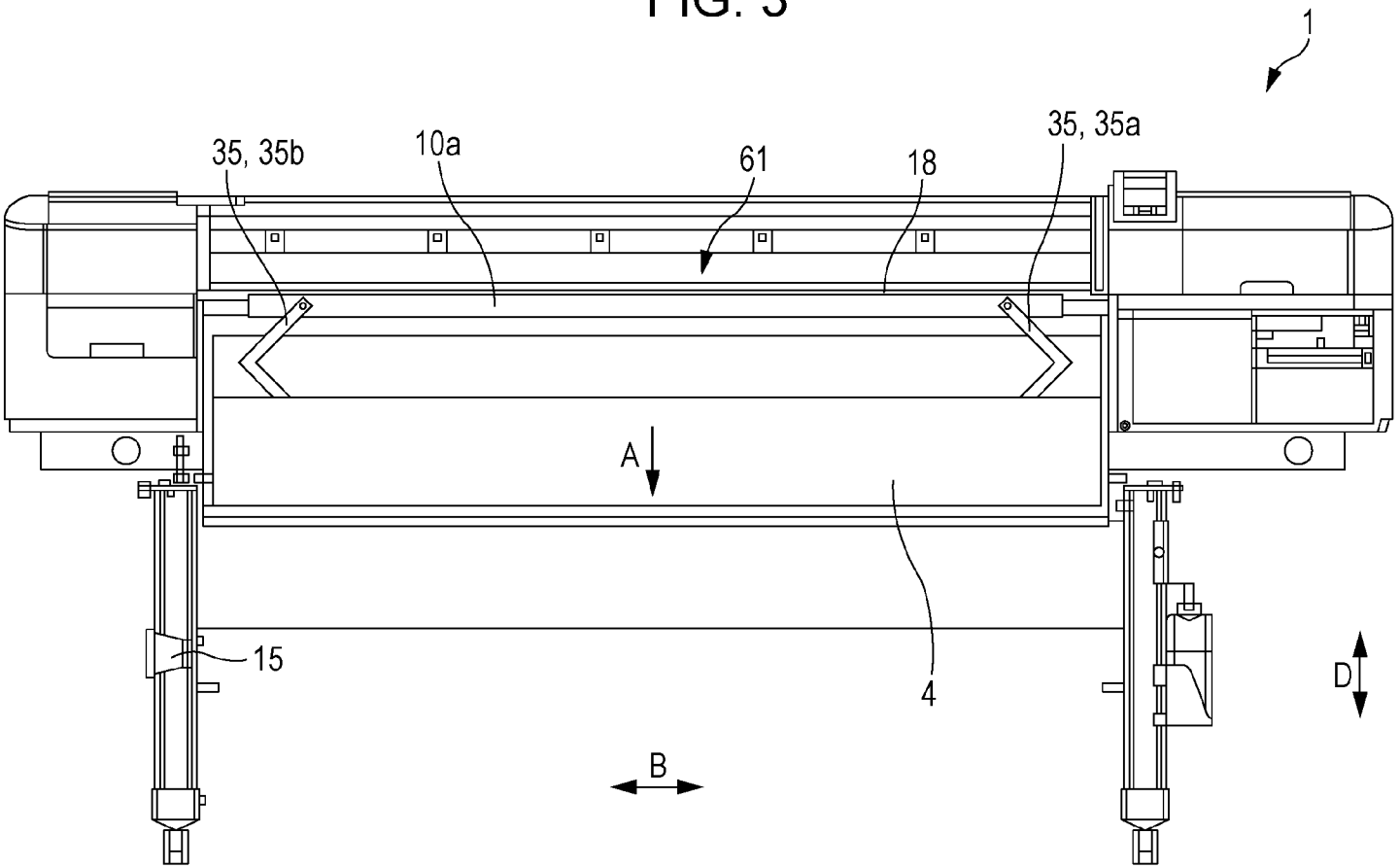
FIG. 3 is a schematic front view illustrating the recording apparatus according to the first embodiment of the invention.
Figure 4:
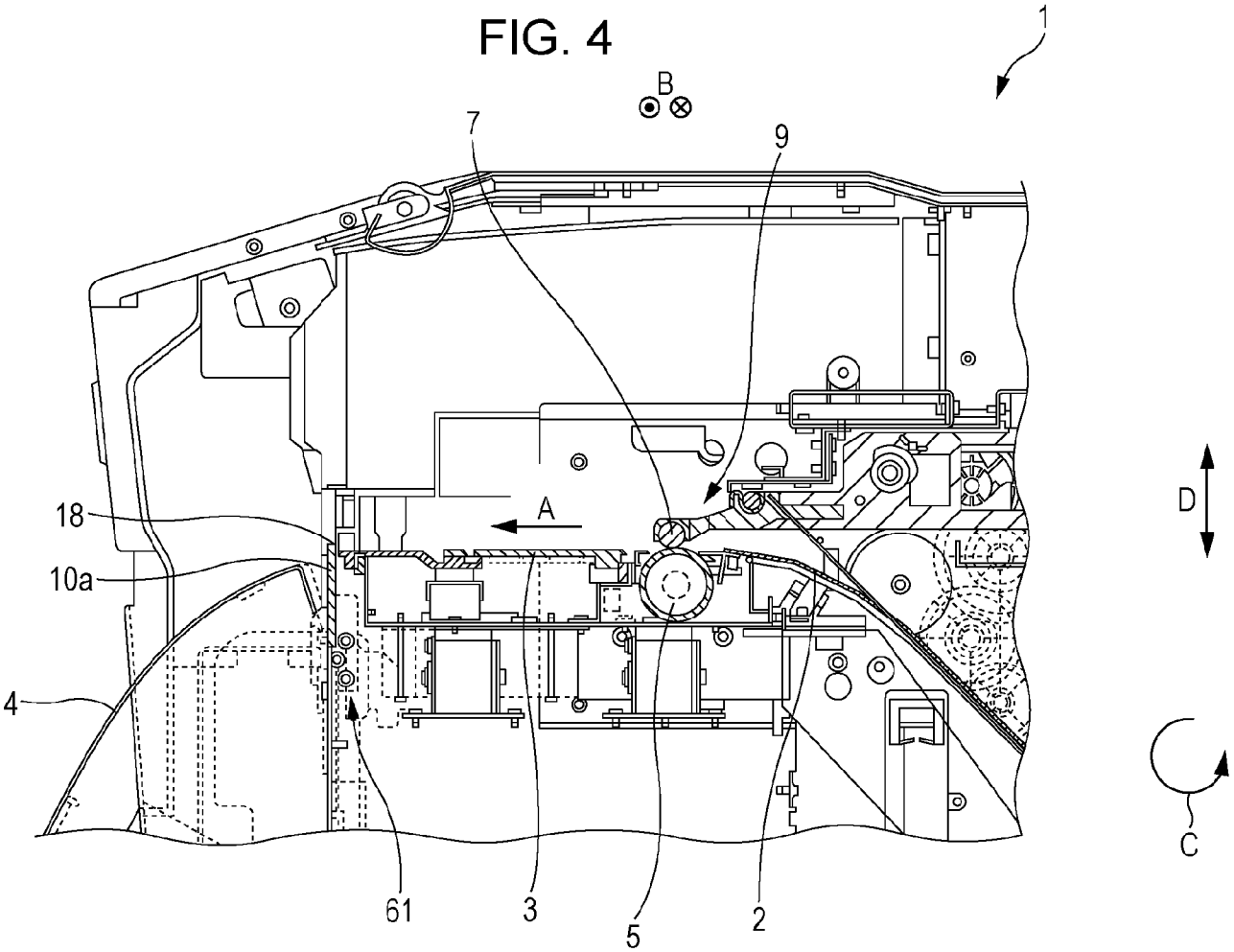
FIG. 4 is a schematic side view illustrating a main portion of the recording apparatus according to the first embodiment of the invention.

FIG. 1 is a schematic side view illustrating a recording apparatus 1 of the present embodiment. FIG. 2 is a schematic perspective view illustrating the recording apparatus 1 of the present embodiment. FIG. 3 is a schematic front view illustrating the recording apparatus 1 of the present embodiment. FIG. 4 is a schematic side view illustrating a frictional force exerting unit 61 constituting a main portion of the recording apparatus 1 of the present embodiment and capable of adjusting the direction of transport of a medium, as well as the surroundings thereof. A part of constituent members of the recording apparatus 1 is not illustrated in FIG. 1 to FIG. 4. Particularly, a casing and a carriage 11 are not illustrated in FIG. 2 so that the frictional force exerting unit 61 constituting a main portion of the present embodiment and capable of adjusting the direction of transport of the medium can be easily seen, and a part of a platen 4 is not illustrated in FIG. 3 so that the frictional force exerting unit 61 can be easily seen.

As illustrated in FIG. 1, the recording apparatus 1 of the present embodiment transports a recording medium P in a transport direction A from a setting unit 14 for setting the recording medium P (medium) until a winding unit 15 for winding the recording medium P through a platen 2, a platen 3, and a platen 4, all of which are units supporting the recording medium P. That is, the path from the setting unit 14 until the winding unit 15 is a transport path of the recording medium P in the recording apparatus 1, and the platen 2, the platen 3, and the platen 4 are units disposed on the transport path to support the recording medium P. The setting unit 14 transfers the recording medium P by rotating in a rotational direction C, and the winding unit 15 winds the recording medium P by rotating in the rotational direction C.

The present embodiment employs the recording medium P wound into a roll such that the outer side thereof is a recording side 16. Thus, a rotating shaft of the setting unit 14 rotates in the rotational direction C when the recording medium P is transferred out of the setting unit 14. Meanwhile, when the recording medium P wound into a roll such that the inner side thereof is the recording side 16 is employed, the rotating shaft of the setting unit 14 can rotate in the opposite direction to the rotational direction C to transfer the recording medium P out of the setting unit 14.

Similarly, the winding unit 15 of the present embodiment winds the recording medium P such that the outer side thereof is the recording side 16. Thus, a rotating shaft of the winding unit 15 rotates in the rotational direction C. Meanwhile, when the recording medium P is wound such that the inner side thereof is the recording side 16, the rotating shaft of the winding unit 15 can rotate in the opposite direction to the rotational direction C.

While the recording apparatus 1 of the present embodiment is configured to be capable of performing recording on the roll-shaped recording medium P, the recording apparatus 1, not being limited to such a configuration, may be configured to be capable of performing recording on the recording medium P that is cut. When the recording apparatus 1 is configured to be capable of performing recording on the cut recording medium P, a so-called paper feed tray (paper transport tray) and a paper feed cassette (paper transport cassette), for example, may be employed as the setting unit 14 setting the recording medium P. In addition, as a collecting unit other than the winding unit 15 for collecting the recording medium P, a so-called discharge receiving unit, a paper discharge tray (discharge tray), and a paper discharge cassette (discharge cassette), for example, may be employed.

The recording apparatus 1 of the present embodiment includes a driving roller 5 disposed between the platen 2 and the platen 3. The driving roller 5 includes a rotating shaft in an intersecting direction B intersecting with the transport direction A and exerts a forwarding force to a side 17 of the recording medium P opposite to the recording side 16.

A driven roller 7 including a rotating shaft in the intersecting direction B is disposed on the side of the transport path of the recording medium P facing the driving roller 5. The driving roller 5 and the driven roller 7 constituting a pair of rollers can pinch the recording medium P. With such a configuration, the driving roller 5, the driven roller 7, and the like constitute a transporting unit 9. A driven roller herein means a roller rotated by the transport of the recording medium P.

When the recording medium P is transported in the transport direction A, the driving roller 5 rotates in the rotational direction C, and the driven roller 7 rotates in the opposite direction to the rotational direction C.

The recording apparatus 1 of the present embodiment includes a recording head 12 as a recording unit on the side facing the platen 3. The recording apparatus 1 forms a desired image by causing ink to be discharged to the recording medium P from a nozzle formed face F of the recording head 12 while causing the recording head 12 to reciprocate in the intersecting direction B with a carriage 11. With such a configuration, the recording head 12 can discharge ink to the recording medium P.

While the recording apparatus 1 of the present embodiment includes the recording head 12 performing recording while reciprocating, it is also possible to employ a recording apparatus including a so-called line head in which a plurality of nozzles discharging ink is disposed in the intersecting direction B intersecting with the transport direction A.

A "line head" herein is a recording head employed in a recording apparatus that includes a region of nozzles formed in the intersecting direction B, which intersects with the transport direction A of the recording medium P, to be capable of covering the entire recording medium P in the intersecting direction B and that forms an image by relatively moving the recording head or the recording medium P. The region of nozzles in the intersecting direction B of the line head may not necessarily be capable of covering all types of the recording medium P that the recording apparatus supports entirely in the intersecting direction B.

While the recording head 12 of the present embodiment is a recording unit capable of performing recording by discharging liquid ink to the recording medium P, the recording head 12 is not limited to such a recording unit. A transfer recording unit, for example, performing recording by transferring coloring matter onto the recording medium P may also be employed.

A sensor 8 capable of detecting both edge portions of the recording medium P in the intersecting direction B is disposed in the carriage 11.

As such, by disposing the sensor 8 as a detecting unit capable of detecting the direction of the recording medium P transported by the transporting unit 9 in the carriage 11 as a moving object moving together with the recording head 12 in the intersecting direction B, the end portions of the recording medium P in the intersecting direction B can be simply detected. Thus, skewing of the transported recording medium P can be detected without the necessity of detecting the lead end portion or the tail end portion of the recording medium P in the transport direction A. Therefore, even if either a continuous medium such as the roll-shaped recording medium P or a cut medium is employed, the recording apparatus 1 of the present embodiment is configured to be capable of preventing skewing of the transported recording medium P by adjusting the direction of transport with the frictional force exerting unit 61 or a rotating object 62, described below, on the basis of a detection result from the sensor 8.

The recording apparatus 1 of the present embodiment includes the frictional force exerting unit 61 disposed on the downstream side of the recording head 12 in the transport direction A on the transport path of the recording medium P. The frictional force exerting unit 61 includes an elevating unit 35 in both end portions thereof in the intersecting direction B. The frictional force exerting unit 61 is arranged at a position between the platen 3 and the platen 4 where the frictional force exerting unit 61 can come into contact with the side 17 of the recording medium P opposite to the recording side 16 on which recording is performed by the recording head 12.

Hereafter, the frictional force exerting unit 61 will be described.

Figure 5:
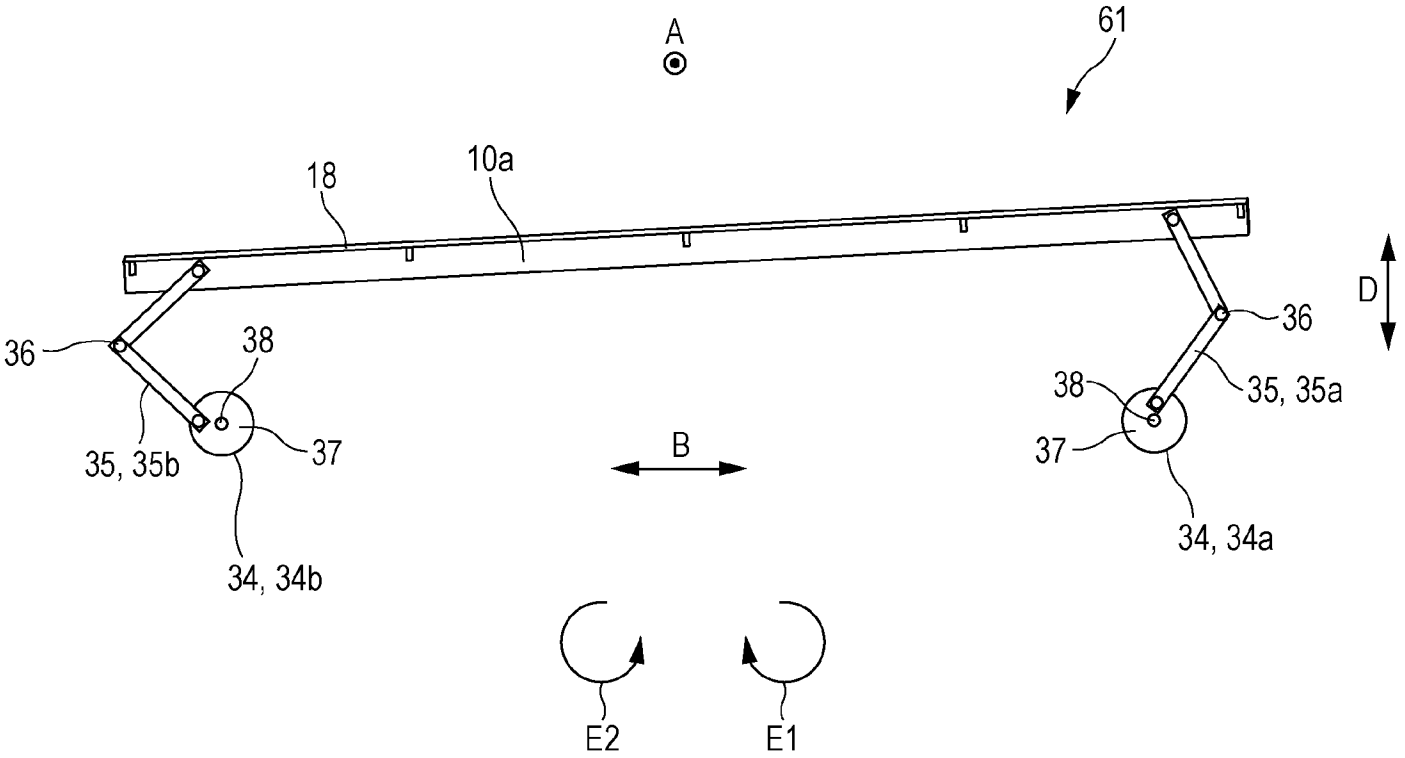
FIG. 5 is a schematic front view illustrating a main portion of the recording apparatus according to the first embodiment of the invention.
Figure 6:
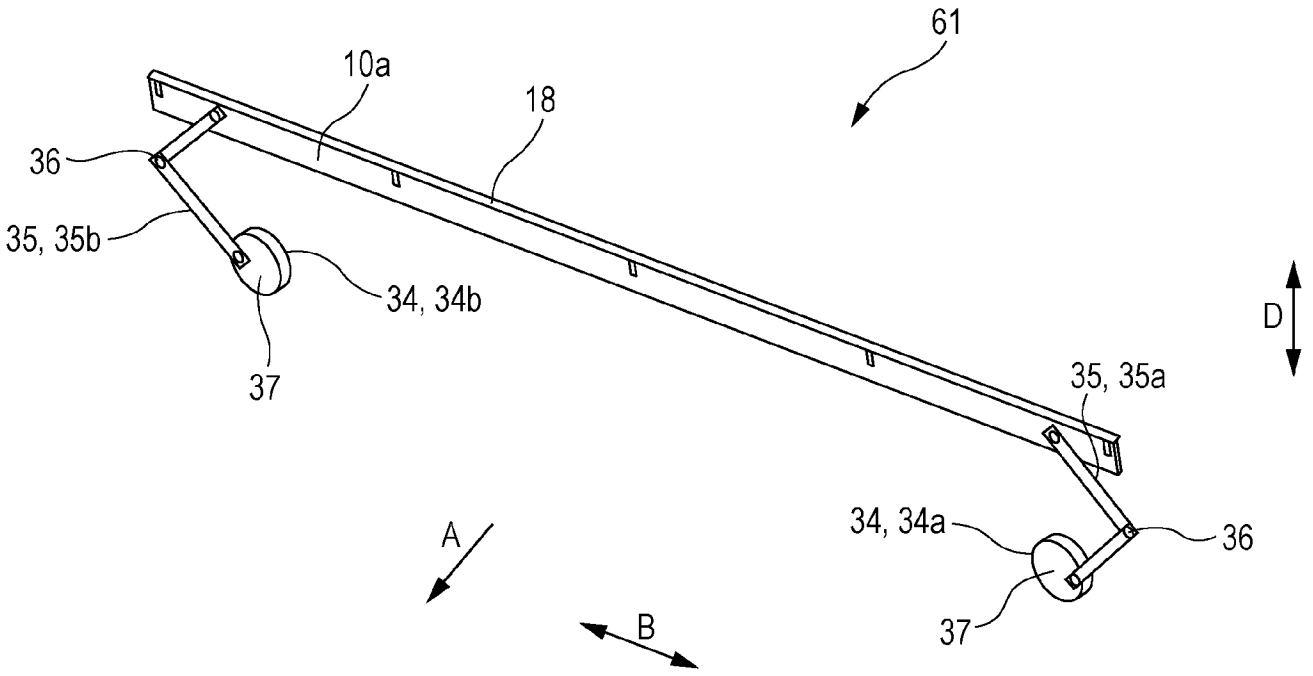
FIG. 6 is a schematic perspective view illustrating a main portion of the recording apparatus according to the first embodiment of the invention.
Figure 7B:
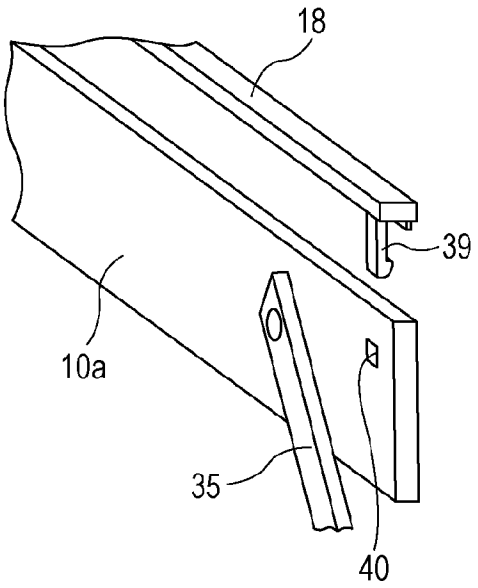
FIGS. 7A and 7B are schematic perspective views illustrating a main portion of the recording apparatus according to the first embodiment of the invention.

FIG. 5 to FIG. 7B are schematic diagrams of the frictional force exerting unit 61: FIG. 5 illustrates a schematic front view of the frictional force exerting unit 61, and FIG. 6 to FIG. 7B illustrate schematic perspective views of the frictional force exerting unit 61.

As illustrated in FIG. 3 and FIG. 5 to FIG. 7B, the frictional force exerting unit 61 of the present embodiment includes a plate-shaped unit 10*a* extending in the intersecting direction B, the elevating unit 35 of which one end is connected to both end portions in the intersecting direction B of the plate-shaped unit 10*a*, a rotating unit 34 to which the other end of the elevating unit 35 is connected, and a contact unit 18 attached to the plate-shaped unit 10*a* along the intersecting direction B to be capable of coming into contact with the side 17 of the recording medium P.

The frictional force exerting unit 61 of the present embodiment includes rotating units 34*a* and 34*b* as the rotating unit 34 and includes elevating units 35*a* and 35*b* as the elevating unit 35. The rotating units 34*a* and 34*b* are connected to a frictional force exerting unit drive motor 22*a* (refer to FIG. 8), and the rotating unit 34*a* is connected to the elevating unit 35*a* while the rotating unit 34*b* is connected to the elevating unit 35*b*. As illustrated in FIG. 5, the rotating units 34*a* and 34*b* can rotate in rotational directions E1 and E2 around a rotating shaft 38 positioned at the center of a side face 37. The elevating units 35*a* and 35*b* include a joint unit 36 to be capable of bending to stretch in an elevating direction D and are connected to parts of the rotating units 34*a* and 34*b* on the side face 37 separated from the rotating shaft 38. With such a configuration, the elevating unit 35*a* side of the plate-shaped unit 10*a* can be moved in the elevating direction D intersecting with both of the transport direction A and the intersecting direction B by rotating the rotating unit 34*a*. Similarly, the elevating unit 35*b* side of the plate-shaped unit 10*a* can be moved in the elevating direction D by rotating the rotating unit 34*b*.

Figure 7A:
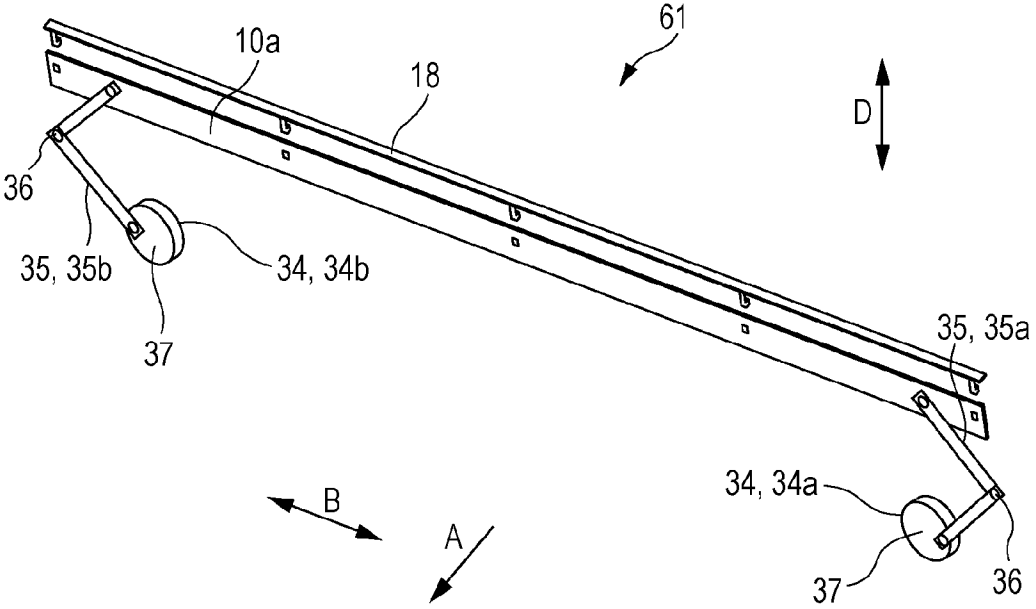

The contact unit 18 is configured to be simply attachable and detachable with respect to the plate-shaped unit 10*a*. FIG. 5 and FIG. 6 illustrate the contact unit 18 attached to the plate-shaped unit 10*a*, and FIGS. 7A and 7B illustrate the contact unit 18 detached from the plate-shaped unit 10*a*. FIG. 7B is a partial enlarged view of the entire frictional force exerting unit 61 illustrated in FIG. 7A.

As illustrated in FIG. 7B, a protruding unit 39 capable of being fit into a hole unit 40 of the plate-shaped unit 10*a* is disposed in the contact unit 18. With such a configuration, the contact unit 18 of the present embodiment can be simply attached and detached with respect to the plate-shaped unit 10*a* by fitting and withdrawing the protruding unit 39 with respect to the hole unit 40. That is, the contact unit 18 can be simply exchanged when, for example, being worn or damaged. In addition, the contact unit 18 can be simply exchanged according to a type of the recording medium P employed.

Even though the material constituting the contact unit 18 is not particularly limited, it may be preferable to employ, for example, polyacetal, polyamide, polytetrafluoroethylene, polyphenylene sulfide, elastomer, phenol resin, polyester, polyimide, synthetic leather, or cork.

Next, an electrical configuration of the recording apparatus 1 of the present embodiment will be described.

Figure 8:
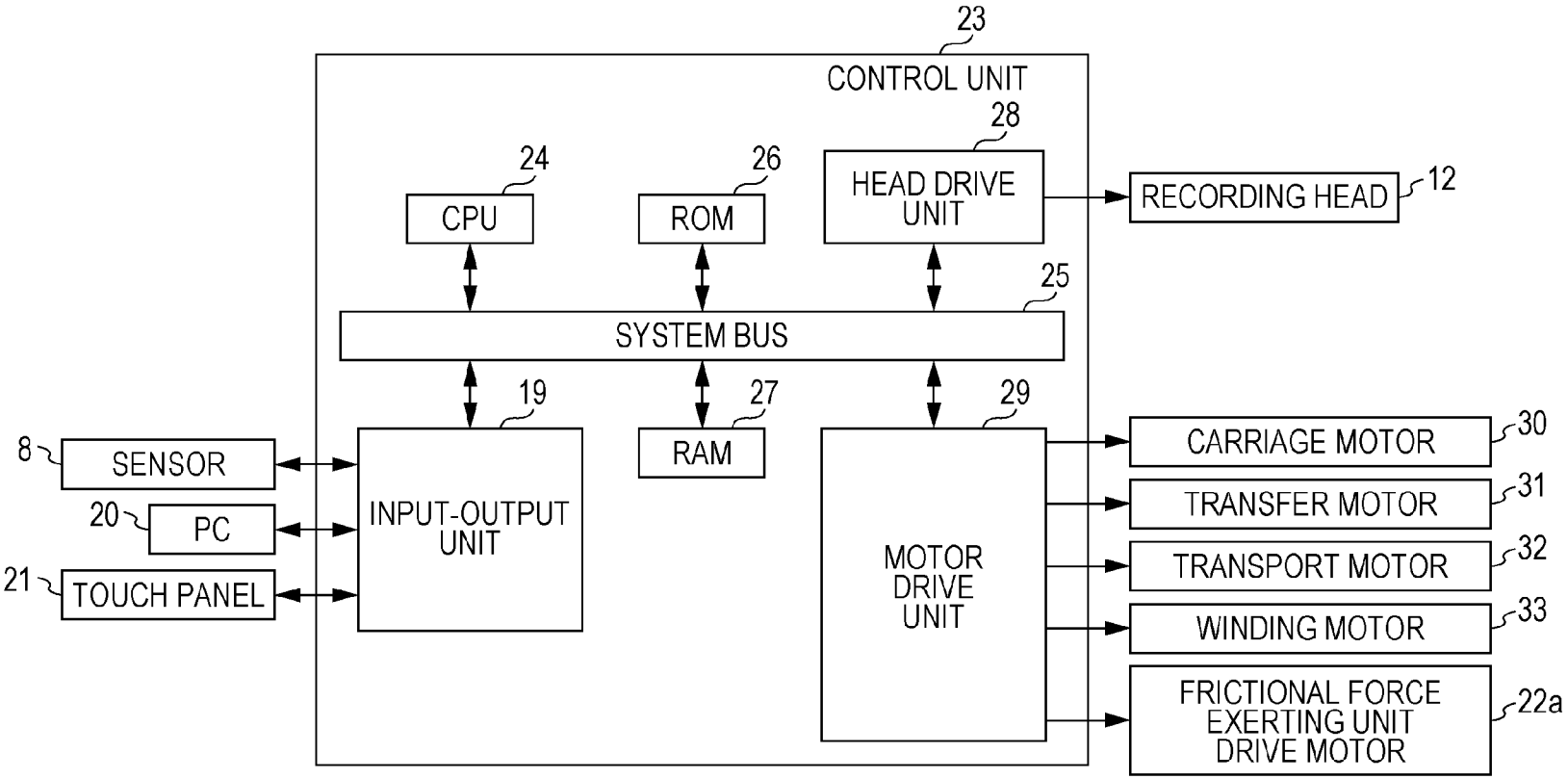
FIG. 8 is a block diagram of the recording apparatus according to the first embodiment of the invention.

FIG. 8 is a block diagram of the recording apparatus 1 of the present embodiment.

A CPU 24 in charge of controlling the entire recording apparatus 1 is disposed in a control unit 23. The CPU 24 is connected, through a system bus 25, to a ROM 26 storing various types of control programs and the like executed by the CPU 24 and to a RAM 27 capable of temporarily storing data.

The CPU 24 is connected to a head drive unit 28 intended to drive the recording head 12 through the system bus 25.

In addition, the CPU 24 is connected, through the system bus 25, to a carriage motor 30 intended to move the carriage 11, a transfer motor 31 as a drive source of the setting unit 14, a transport motor 32 as a drive source of the driving roller 5, a winding motor 33 as a drive source of the winding unit 15, and a motor drive unit 29 intended to drive the frictional force exerting unit drive motor 22*a* capable of rotating the rotating unit 34 of the frictional force exerting unit 61 in the rotational directions E1 and E2.

Furthermore, the CPU 24 is connected to an input-output unit 19 through the system bus 25, and the input-output unit 19 is connected to the sensor 8, a PC 20 as an external apparatus inputting recording data and the like into the recording apparatus 1, and a touch panel 21 capable of receiving input of information from a user or displaying information related to the recording apparatus 1.

The control unit 23 of the present embodiment, with such a configuration, can control contact between the recording medium P and the frictional force exerting unit 61 capable of coming into contact with and separating from the side 17 of the recording medium P opposite to the recording side 16 by rotating the rotating units 34*a* and 34*b* on the basis of the detection result from the sensor 8. For example, the control unit 23 can increase frictional force on the elevating unit 35*a* side in the intersecting direction B by rotating the rotating unit 34*a* to bring the elevating unit 35*a* side of the plate-shaped unit 10*a* into contact with the recording medium P or can increase frictional force on the elevating unit 35*b* side in the intersecting direction B by rotating the rotating unit 34*b* to bring the elevating unit 35*b* side of the plate-shaped unit 10*a* into contact with the recording medium P.

As such, the recording apparatus 1 of the present embodiment includes the frictional force exerting unit 61 capable of coming into contact with and separating from the side 17 of the recording medium P opposite to the recording side 16 and capable of coming into contact with at least a part in the intersecting direction B of the side 17 of the recording medium P opposite to the recording side 16 to exert different frictional force in the intersecting direction B to the recording medium P when the recording medium P is transported by the transporting unit 9. In addition, the recording apparatus 1 includes the control unit 23 controlling contact between the recording medium P and the frictional force exerting unit 61 on the basis of the detection result from the sensor 8 capable of detecting the direction of the recording medium P transported by the transporting unit 9. Thus, since frictional force can be adjusted in the intersecting direction B depending on the direction of the recording medium P skewed during transport thereof, the recording apparatus 1 is configured to be capable of preventing skewing of the transported recording medium P without damaging the recording side 16 of the recording medium P.

While the frictional force exerting unit 61 of the present embodiment is disposed between the platen 3 and the platen 4, there is no particular limitation on the position where the frictional force exerting unit 61 is disposed.

As illustrated in FIG. 3 to FIG. 7B, the frictional force exerting unit 61 of the present embodiment is an extending member extending in the intersecting direction B. In addition, the control unit 23 can control the contact region between the frictional force exerting unit 61 and the recording medium P in the intersecting direction B by changing the angle between the recording medium P and the frictional force exerting unit 61 in the intersecting direction B viewed from the transport direction A (refer to FIG. 9B, FIG. 10B, and FIG. 11B).

Thus, frictional force exerted on the recording medium P can be simply adjusted in the intersecting direction B by changing the angle between the recording medium P and the frictional force exerting unit 61 in the intersecting direction B viewed from the transport direction A.

Next, a specific description will be provided, by using FIG. 9A to FIG. 11B, of the specific content of control performed by the control unit 23 on the frictional force exerting unit 61, that is, changing the angle between the recording medium P and the frictional force exerting unit 61 in the intersecting direction B viewed from the transport direction A to adjust frictional force exerted on the recording medium P in the intersecting direction B.

The recording apparatus 1 of the present embodiment, under control of the control unit 23, performs recording by alternately repeating a transport operation of transporting the recording medium P in the transport direction A and a discharge operation of stopping the transport operation and discharging ink from the recording head 12 while moving the carriage 11 where the recording head 12 is disposed in the intersecting direction B. That is, the recording apparatus 1 of the present embodiment forms an image while transporting the recording medium P intermittently under control of the control unit 23.

In addition, the sensor 8 of the present embodiment is disposed in the carriage 11 and is capable of detecting the end portions in the intersecting direction B of the recording medium P. Thus, the end portions can be detected along with the discharge operation before and after the transport operation. Therefore, from the positions of the end portions detected before and after the transport operation, the control unit 23 can determine whether or not the recording medium P is transported askew as well as whether the recording medium P is transported askew toward the elevating unit 35*a* or the recording medium P is transported askew toward the elevating unit 35*b*.

Figure 9A:
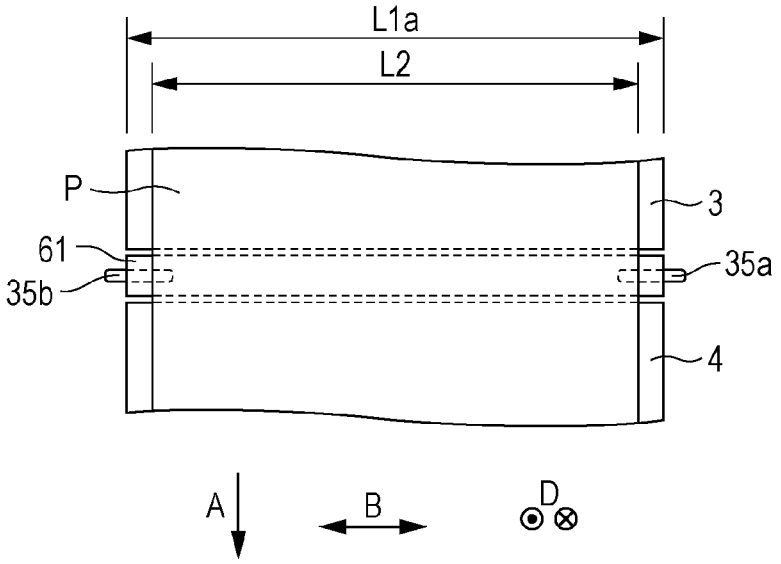
FIGS. 9A and 9B are schematic diagrams illustrating a main portion of the recording apparatus according to the first embodiment of the invention.
Figure 9B:
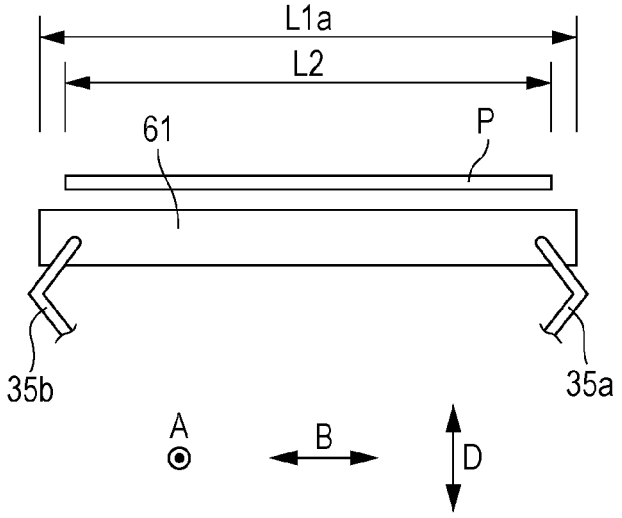

FIGS. 9A and 9B are diagrams illustrating a state where the recording medium P is not skewed during transport thereof in the recording apparatus 1 of the present embodiment. FIG. 9A illustrates a schematic plan view of the frictional force exerting unit 61 constituting a main portion of the recording apparatus 1 of the present embodiment as well as the surroundings thereof, and FIG. 9B illustrates a schematic front view of the frictional force exerting unit 61 and the surroundings thereof.

As illustrated in FIG. 9B, when the recording medium P is not skewed during transport thereof, the recording apparatus 1 of the present embodiment maintains non-contact between the frictional force exerting unit 61 and the recording medium P under control of the control unit 23.

As illustrated in FIG. 9A and FIG. 9B, a length L1*a* of the frictional force exerting unit 61 in the intersecting direction B in the recording apparatus 1 of the present embodiment is greater than or equal to a length (width) L2 of the recording medium P in the intersecting direction B. In other words, the length L1*a* of the frictional force exerting unit 61 in the intersecting direction B is greater than or equal to the length of transport of the recording medium P in the intersecting direction B on the transport path of the recording medium P. Thus, the frictional force exerting unit 61 is configured to be capable of coming into contact with the recording medium P in both of the widthwise end portions of the recording medium P and capable of effectively preventing skewing of the transported recording medium P.

Figure 10A:
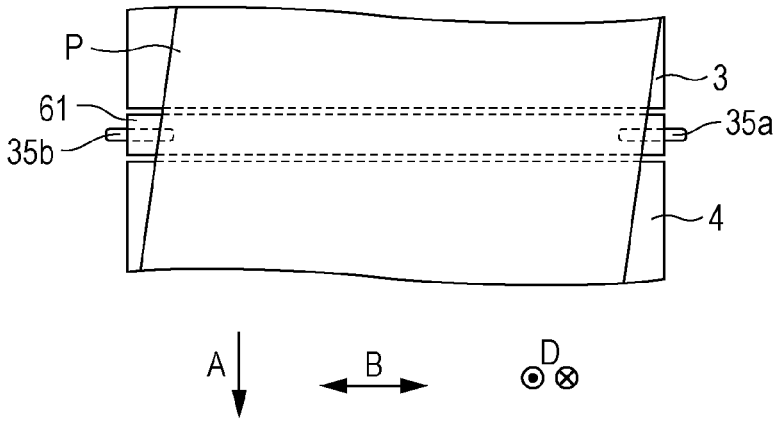
FIGS. 10A and 10B are schematic diagrams illustrating a main portion of the recording apparatus according to the first embodiment of the invention.
Figure 10B:
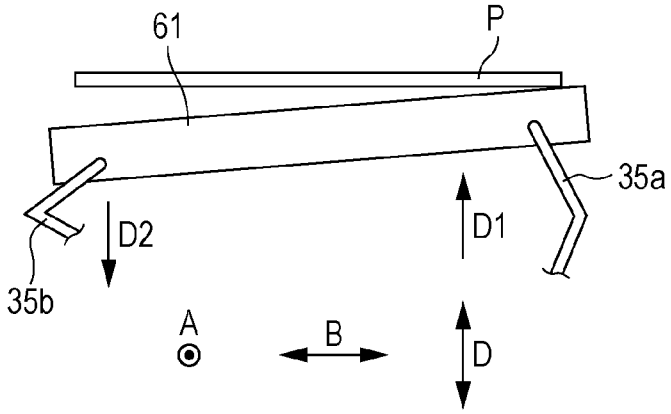

Meanwhile, FIGS. 10A and 10B are diagrams illustrating a state where the recording medium P is skewed toward the elevating unit 35*b* side thereof while being transported downstream of the transport direction A in the recording apparatus 1 of the present embodiment. FIG. 10A illustrates a schematic plan view of the frictional force exerting unit 61 constituting a main portion of the recording apparatus 1 of the present embodiment as well as the surroundings thereof, and FIG. 10B illustrates a schematic front view of the frictional force exerting unit 61 and the surroundings thereof.

As illustrated in FIG. 10B, when the recording medium P is skewed toward the elevating unit 35*b* side thereof while being transported downstream of the transport direction A, the recording apparatus 1 of the present embodiment brings the elevating unit 35*a* side of the frictional force exerting unit 61 in the intersecting direction B into contact with the recording medium P under control of the control unit 23. In such a state, frictional force is generated on the elevating unit 35*a* side of the recording medium P in the intersecting direction B. Thus, in this state, frictional force is more greatly exerted on the elevating unit 35*a* side of the recording medium P than on the elevating unit 35*b* side thereof in the opposite direction to the transport direction A. That is, a force pulling the recording medium P upstream of the transport direction A is more strongly applied on the elevating unit 35*a* side of the recording medium P than on the elevating unit 35*b* side thereof. When such a force is applied to the recording medium P, the amount of transport is greater on the elevating unit 35*b* side of the recording medium P than on the elevating unit 35*a* side thereof during the transport operation of transporting the recording medium P, thereby alleviating skewing of the transported recording medium P.

Figure 11A:
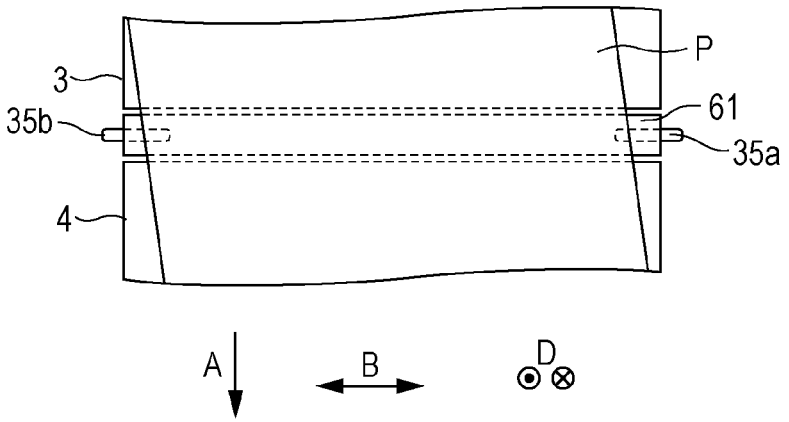
FIGS. 11A and 11B are schematic diagrams illustrating a main portion of the recording apparatus according to the first embodiment of the invention.
Figure 11B:
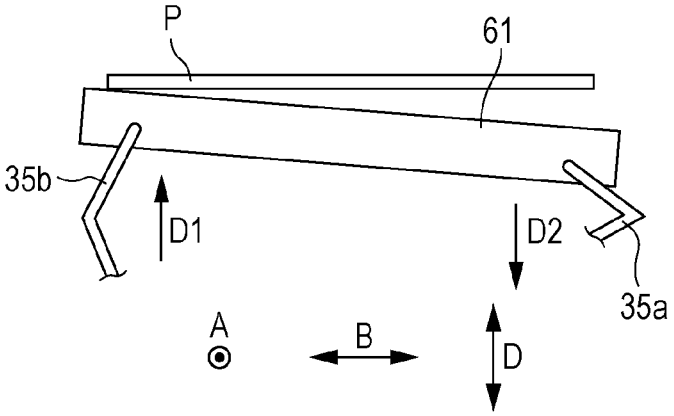

Meanwhile, FIGS. 11A and 11B are diagrams illustrating a state where the recording medium P is skewed toward the elevating unit 35*a* side thereof while being transported downstream of the transport direction A in the recording apparatus 1 of the present embodiment. FIG. 11A illustrates a schematic plan view of the frictional force exerting unit 61 constituting a main portion of the recording apparatus 1 of the present embodiment as well as the surroundings thereof, and FIG. 11B illustrates a schematic front view of the frictional force exerting unit 61 and the surroundings thereof.

As illustrated in FIG. 11B, when the recording medium P is skewed toward the elevating unit 35*a* side thereof while being transported downstream of the transport direction A, the recording apparatus 1 of the present embodiment brings the elevating unit 35*b* side of the frictional force exerting unit 61 in the intersecting direction B into contact with the recording medium P under control of the control unit 23. In such a state, frictional force is generated on the elevating unit 35*b* side of the recording medium P in the intersecting direction B. Thus, in this state, frictional force is exerted more greatly on the elevating unit 35*b* side of the recording medium P than on the elevating unit 35*a* side thereof in the opposite direction to the transport direction A. That is, a force pulling the recording medium P upstream of the transport direction A is more strongly applied on the elevating unit 35*b* side of the recording medium P than on the elevating unit 35*a* side thereof. When such a force is applied to the recording medium P, the amount of transport is greater on the elevating unit 35*a* side of the recording medium P than on the elevating unit 35*b* side thereof during the transport operation of transporting the recording medium P, thereby alleviating skewing of the transported recording medium P.

As described above, the recording apparatus 1 of the present embodiment is configured such that the carriage 11 where the recording head 12 is disposed includes the sensor 8. However, the recording apparatus 1 is not limited to such a configuration.

For example, the sensor 8 may be configured to be disposed further upstream of the transport direction A than the recording head 12. In the case of such a configuration, skewing of the transported recording medium P can be detected before recording. Thus, it is possible to prevent degradation of the quality of an image recorded on the recording medium P.

Alternatively, when the recording apparatus 1 of the present embodiment is configured such that the winding unit 15 capable of winding the recording medium P is included further downstream of the transport direction A than the recording head 12, the sensor 8 may be configured to be disposed further downstream of the transport direction A than the recording head 12 as well as further upstream of the transport direction A than the winding unit 15. In the case of such a configuration, skewing of the transported recording medium P can be detected before the recording medium P is wound. Thus, failure to wind the recording medium P such as winding the recording medium P onto the winding unit 15 slantwise can be effectively prevented.

Second Embodiment

Figure 12A:
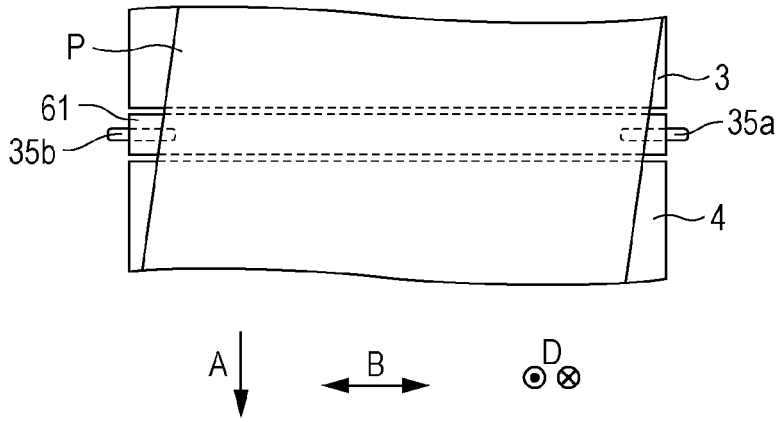
FIGS. 12A and 12B are schematic diagrams illustrating a main portion of a recording apparatus according to a second embodiment of the invention.
Figure 12B:
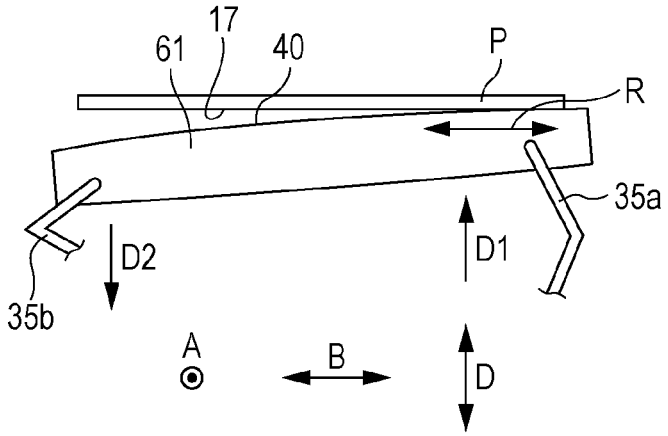

FIGS. 12A and 12B

Next, a recording apparatus of a second embodiment will be described in detail with reference to the appended drawings.

FIGS. 12A and 12B are schematic diagrams of the frictional force exerting unit 61 constituting a main portion of the recording apparatus 1 of the present embodiment as well as the surroundings thereof and are diagrams corresponding to FIGS. 10A and 10B of the recording apparatus 1 of the first embodiment. Constituent members of the present embodiment common to the first embodiment will be designated by the same reference sign and will not be described in detail.

The recording apparatus 1 of the present embodiment has the same configuration as the recording apparatus 1 of the first embodiment except for the configuration of the frictional force exerting unit 61.

FIGS. 12A and 12B are diagrams illustrating a state where the recording medium P is skewed toward the elevating unit 35*b* side thereof while being transported downstream of the transport direction A in the recording apparatus 1 of the present embodiment. FIG. 12A illustrates a schematic plan view of the frictional force exerting unit 61 constituting a main portion of the recording apparatus 1 of the present embodiment as well as the surroundings thereof, and FIG. 12B illustrates a schematic front view of the frictional force exerting unit 61 and the surroundings thereof.

As illustrated in FIG. 12B, when the recording medium P is skewed toward the elevating unit 35*b* side thereof while being transported downstream of the transport direction A, the recording apparatus 1 of the present embodiment can bring the elevating unit 35*a* side of the frictional force exerting unit 61 in the intersecting direction B into contact with the recording medium P under control of the control unit 23, in the same manner as the recording apparatus 1 of the first embodiment.

As illustrated in FIG. 12B, the frictional force exerting unit 61 of the present embodiment is an extending member including an arc face 40 convex toward the side 17 of the recording medium P when viewed from the transport direction A. Thus, when the contact region of the frictional force exerting unit 61 is controlled by changing the angle at which the frictional force exerting unit 61 is positioned, a contact area R between the frictional force exerting unit 61 and the side 17 of the recording medium P can be increased. Therefore, frictional force exerted on the recording medium P in the intersecting direction B can be efficiently adjusted.

The arc face 40 may be an elliptic one in addition to a circular one.

Third Embodiment

FIG. 13

Next, a recording apparatus of a third embodiment will be described in detail with reference to the appended drawings.

Figure 13:
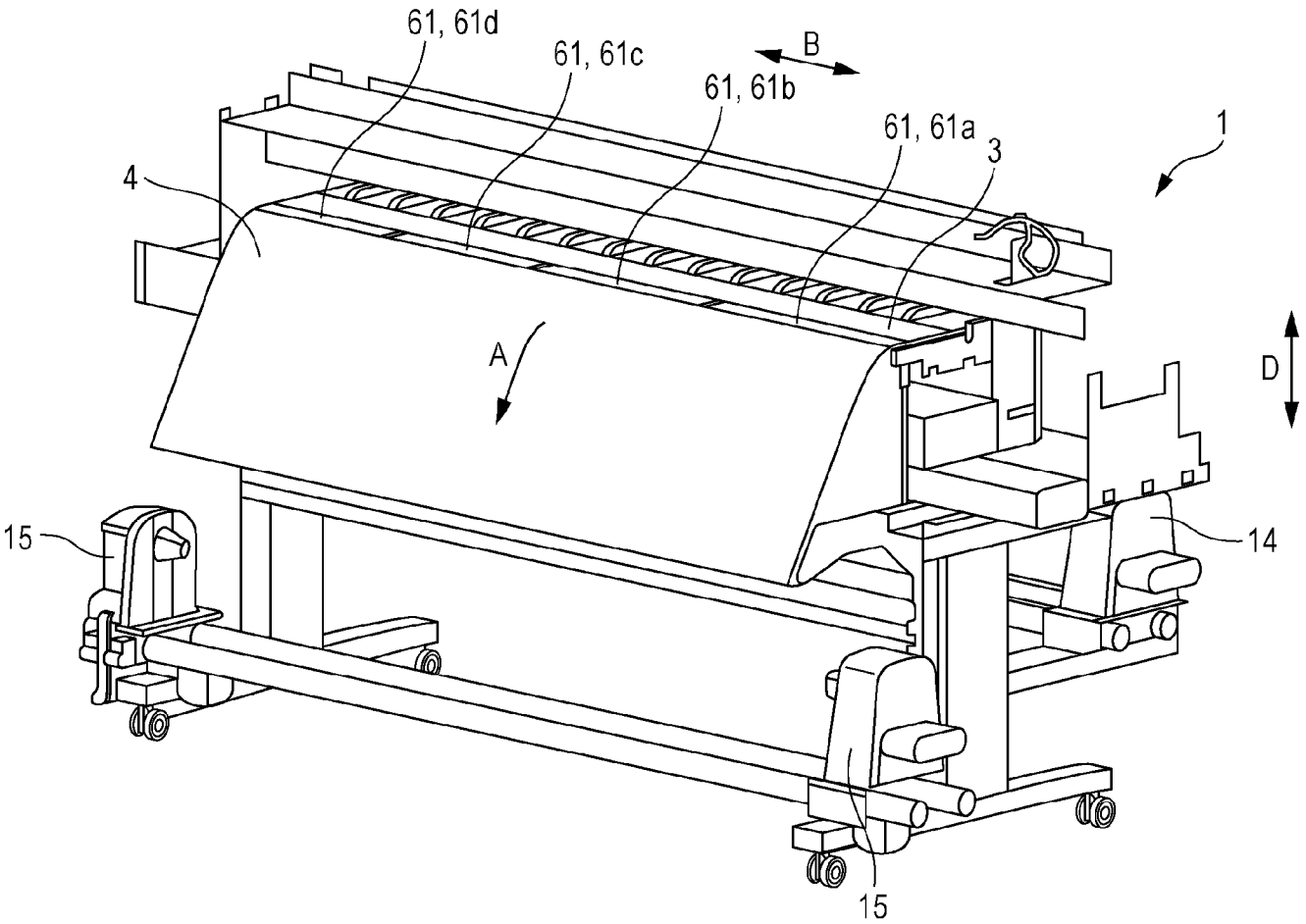
FIG. 13 is a schematic perspective view illustrating a recording apparatus according to a third embodiment of the invention.

FIG. 13 is a schematic perspective view of the recording apparatus 1 of the present embodiment and is a diagram corresponding to FIG. 2 of the recording apparatus 1 of the first embodiment. Constituent members of the present embodiment common to the first and second embodiments will be designated by the same reference sign and will not be described in detail.

The recording apparatus 1 of the present embodiment has the same configuration as the recording apparatus 1 of the first embodiment except for the configuration of the frictional force exerting unit 61.

The frictional force exerting unit 61 of the first embodiment is configured as one extending member extending in the intersecting direction B. Thus, this configuration has the advantage in that only a small number of drive mechanisms is required to change the attitude of the frictional force exerting unit 61. However, the frictional force exerting unit 61 is not limited to such a configuration. As illustrated in FIG. 13, the recording apparatus 1 of the present embodiment is configured to include the frictional force exerting unit 61 capable of moving in the elevating direction D in plural quantities as frictional force exerting units 61*a*, 61*b*, 61*c*, and 61*d* lined up in the intersecting direction B.

Even in the recording apparatus 1 of the present embodiment, frictional force exerted on the recording medium P can be adjusted in the intersecting direction B as in the recording apparatus 1 of the first and second embodiments.

Fourth Embodiment

Figure 14:
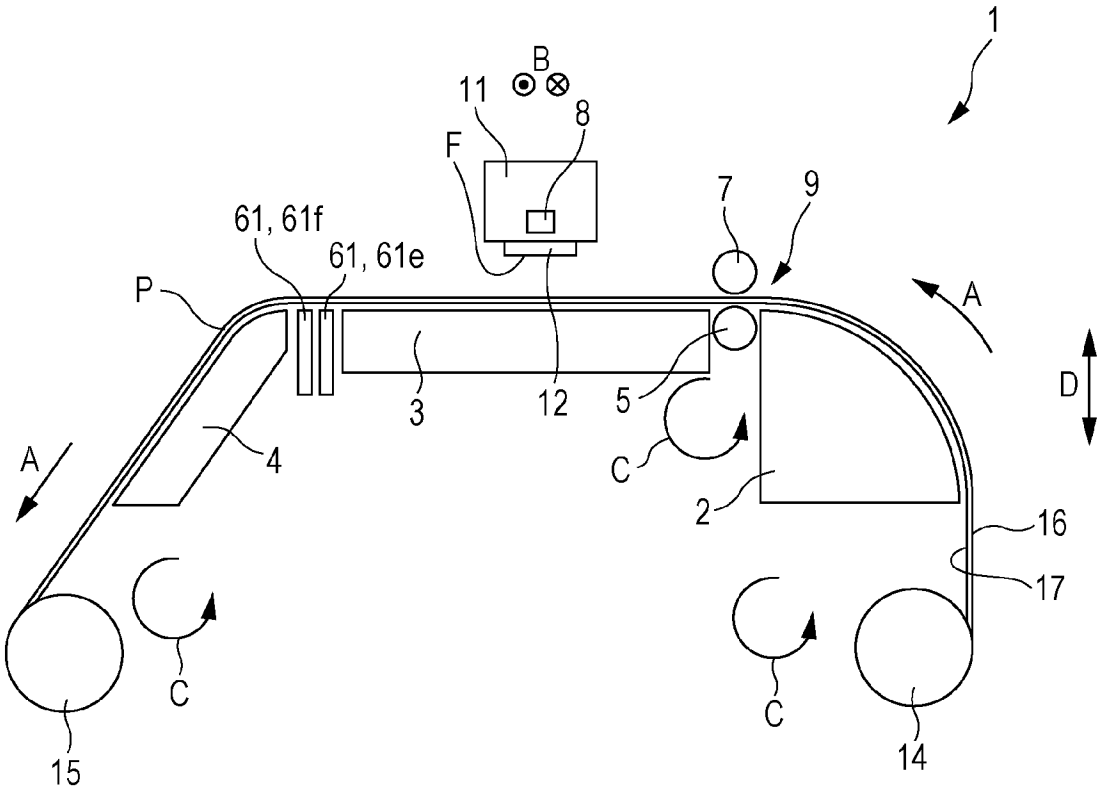
FIG. 14 is a schematic side view illustrating a recording apparatus according to a fourth embodiment of the invention.
Figure 15A:
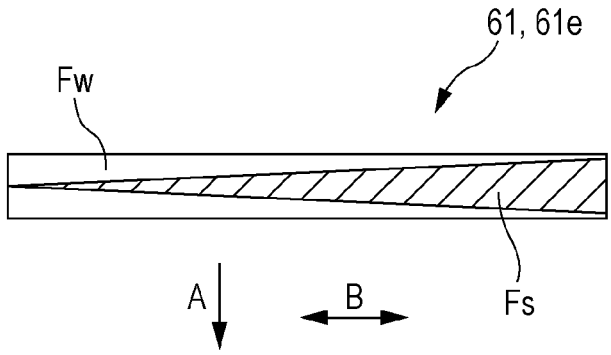
FIGS. 15A and 15B are schematic plan views illustrating a main portion of the recording apparatus according to the fourth embodiment of the invention.
Figure 15B:
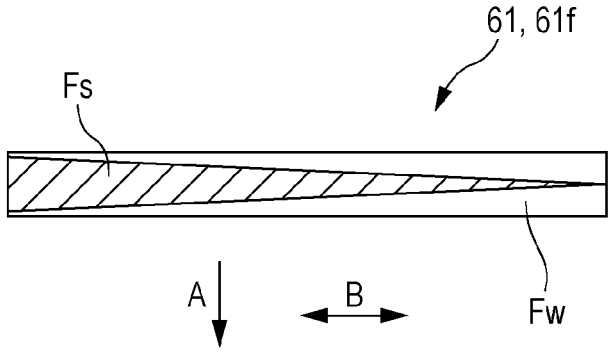

FIG. 14 and FIGS. 15A and 15B

Next, a recording apparatus of a fourth embodiment will be described in detail with reference to the appended drawings.

FIG. 14 is a schematic side view of the recording apparatus 1 of the present embodiment and is a diagram corresponding to FIG. 1 of the recording apparatus 1 of the first embodiment. FIGS. 15A and 15B are schematic plan view of the frictional force exerting unit 61 constituting a main portion of the recording apparatus 1 of the present embodiment and are diagrams illustrating a portion of the frictional force exerting unit 61 in contact with the recording medium P. Constituent members of the present embodiment common to the first to third embodiments will be designated by the same reference sign and will not be described in detail.

The recording apparatus 1 of the present embodiment has the same configuration as the recording apparatus 1 of the first embodiment except for the configuration of the frictional force exerting unit 61.

As illustrated in FIG. 14 and FIGS. 15A and 15B, the recording apparatus 1 of the present embodiment is configured to include the frictional force exerting unit 61 extending in the intersecting direction B in plural quantities as a first frictional force exerting unit 61*e* and a second frictional force exerting unit 61*f*. Each of the first frictional force exerting unit 61*e* and the second frictional force exerting unit 61*f* of the present embodiment can move in the elevating direction D while maintaining a parallel state thereof with the recording medium P in the intersecting direction B when viewed from the transport direction A.

As illustrated in FIG. 15A and FIG. 15B, each of the first frictional force exerting unit 61*e* and the second frictional force exerting unit 61*f* is configured of two regions Fs and Fw. The region Fs is configured to have a higher coefficient of friction against the recording medium P than the region Fw. Thus, when the recording medium P transported comes into contact with the first frictional force exerting unit 61*e* illustrated in FIG. 15A, great frictional force is applied on the right side of FIG. 15A in the left-right direction. Meanwhile, when the recording medium P transported comes into contact with the second frictional force exerting unit 61*f* illustrated in FIG. 15B, great frictional force is applied on the left side of FIG. 15B in the left-right direction.

As such, the first frictional force exerting unit 61*e* is configured to exert frictional force increasing from one side to the other side of the recording medium P in the intersecting direction B on the recording medium P, and the second frictional force exerting unit 61*f* is configured to exert frictional force decreasing from the one side to the other side in the intersecting direction B on the recording medium P.

That is, the recording apparatus 1 of the present embodiment includes, as the frictional force exerting unit 61, the first frictional force exerting unit 61*e* exerting frictional force increasing from the one side to the other side of the recording medium P in the intersecting direction B on the recording medium P and the second frictional force exerting unit 61*f* exerting frictional force decreasing from the one side to the other side on the recording medium P. In addition, the control unit 23 can control contact of the first frictional force exerting unit 61*e* and the second frictional force exerting unit 61*f* with the recording medium P on the basis of the detection result from the sensor 8. Thus, because the frictional force exerting unit 61 having different frictional force distributions in the intersecting direction B can be selected from the first frictional force exerting unit 61*e* and the second frictional force exerting unit 61*f* depending on the direction of the recording medium P skewed during transport thereof, skewing of the transported recording medium P can be prevented.

Examples of a configuration in which frictional force exerted on the recording medium P increases (or decreases) from the one side to the other side of the recording medium P include a configuration in which the area of contact with the recording medium P increases (or decreases) from the one side to the other side, in addition to the configuration of the present embodiment in which frictional force exerted on the recording medium P increases (or decreases) from the one side to the other side.

Fifth Embodiment

Figure 16A:
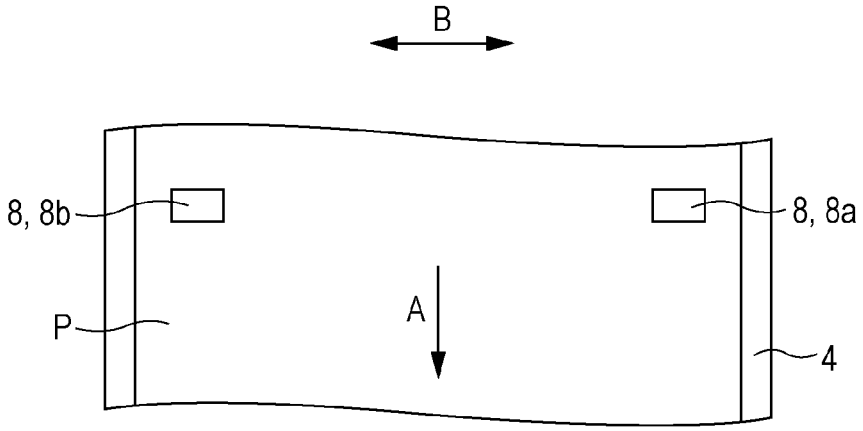
FIGS. 16A and 16B are schematic plan views illustrating a main portion of a recording apparatus according to a fifth embodiment of the invention.
Figure 16B:
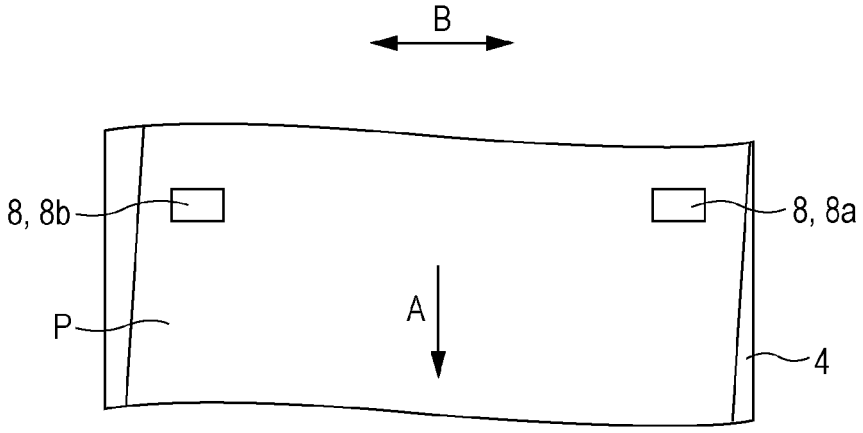

FIGS. 16A and 16B

Next, a recording apparatus of a fifth embodiment will be described in detail with reference to the appended drawings.

FIGS. 16A and 16B are schematic plan views of the recording apparatus 1 of the present embodiment. Constituent members of the present embodiment common to the first to fourth embodiments will be designated by the same reference sign and will not be described in detail.

The recording apparatus 1 of the present embodiment has the same configuration as the recording apparatus 1 of the first embodiment except for the configuration of the sensor 8.

FIGS. 16A and 16B are schematic plan views illustrating the sensor 8 and the surroundings thereof in the recording apparatus 1 of the present embodiment employing a different sensor from the sensor of the recording apparatus 1 of the first embodiment. FIG. 16A is a diagram illustrating a state where the recording medium P is transported without being skewed during transport thereof. Meanwhile, FIG. 16B is a diagram illustrating a state where the recording medium P is transported askew to the left side of FIG. 16B (sensor 8*b* side) while advancing downstream of the transport direction A.

As illustrated in FIGS. 16A and 16B, the recording apparatus 1 of the present embodiment includes, as the sensor 8 detecting the speed of transport of the recording medium P, a sensor 8*a* as a first speed sensor and a sensor 8*b* as a second speed sensor disposed at a different position from the sensor 8*a* in the intersecting direction B intersecting with the transport direction A when viewed from the transport direction A. The control unit 23 serves as a skew detecting unit capable of obtaining a speed difference on the basis of speeds of transport of the recording medium P detected by the sensor 8*a* and the sensor 8*b* and detecting skewing of the recording medium P from the speed difference.

As such, by obtaining a speed difference at different positions in the intersecting direction B such as the left side and the right side of the recording medium P when viewed from the transport direction A and detecting the state of skewing (degree of skewing) of a transported object from the speed difference, it is possible to compensate for inaccurate detection of absolute speed even if speed sensors detecting absolute speed inaccurately are employed as the first speed sensor and the second speed sensor. That is, accuracy can be increased in detecting skewing of the recording medium P.

The reason that it is possible to compensate for inaccurate detection of absolute even if speed sensors detecting absolute speed inaccurately are employed as the first speed sensor and the second speed sensor is as follows.

The control unit 23 calculates the speed difference as follows on the basis of the speeds detected by the sensor 8*a* and the sensor 8*b*.

In the recording apparatus 1 of the present embodiment, each of the sensor 8*a* and the sensor 8*b* is disposed to be capable of being displaced in the intersecting direction B. Thus, the user can arrange the sensors 8*a* and 8*b* such that the distance from the right side end portion of the recording medium P until the sensor 8*a* is equal to the distance from the left side end portion of the recording medium P until the sensor 8*b* in FIGS. 16A and 16B. In such an arrangement of the sensor 8*a* and the sensor 8*b*, given that V1 and V2 are respectively the speed detected by the sensor 8*a* is V1 and the speed detected by the sensor 8*b*, a transport speed Vave of the entire recording medium P is Vave=(V1+V2)/2. The control unit 23 calculates ((V1−V2)/Vave)×100(%) and obtains the resulting value as a speed difference.

While the control unit 23 of the present embodiment calculates ((V1−V2)/Vave)×100(%) as a speed difference, V1−V2 may be employed as a speed difference.

As such, since the state of skewing of the recording medium P is determined by the speed difference, a configuration such as the recording apparatus 1 of the present embodiment accurately detects the state of skewing of the recording medium P even if speed sensors detecting absolute speed inaccurately are employed.

For example, when the state of skewing is determined by the absolute speeds of the speed V1 detected by the sensor 8*a* and the speed V2 detected by the sensor 8*b*, the value detected as the absolute speed may change depending on the type or the like of the recording medium P, thereby impeding accurate determination of the state of skewing.

Meanwhile, according to the present embodiment, the value of ((V1−V2)/Vave)×100(%) does not change even if the speed V1 detected by the sensor 8*a* and the speed V2 detected by the sensor 8*b* change because the ratios of V1 and V2 to Vave do not change. Thus, the state of skewing can be accurately determined.

Even the same speed difference results in the state of transport changing depending on the distances of the sensor 8*a* and the sensor 8*b*. Thus, the state of skewing is determined on the basis of the distances of the sensor 8*a* and the sensor 8*b*.

In the skew detection of the related art detecting the lead end of the recording medium P, it is difficult to produce a valid detection result if a skew detection sensor is not installed at a position where the recording medium P is significantly shifted after being skewed on the transport path thereof. Meanwhile, the recording apparatus 1 of the present embodiment is configured to transport the recording medium P continuously from the setting unit 14 until the winding unit 15, in a so-called roll-to-roll manner. Thus, the degree of skewing tends not to be significantly different at any point on the transport path of the recording medium P when the recording medium P is skewed during transport thereof. Thus, the speed difference (degree of skewing) tends not to change substantially at any position on the transport path of the recording medium P. Therefore, it is possible to increase the freedom of choosing the positions to install the first speed sensor 8*a* and the second speed sensor 8*b*.

In addition, even if the recording medium P is not continuously transported in a roll-to-roll manner, the sensor 8 can be arranged at any position other than the position where skewing of the transported recording medium P is accumulated to determine skewing of the transported recording medium P by determining skewing of the transported recording medium P with the speed difference. Thus, the freedom of choosing the position to install the sensor 8 can be increased in comparison with detecting the absolute speed of the recording medium P to determine the state of skewing or detecting the lead end of the recording medium P to determine the state of skewing, neither of which can accurately determine the state of skewing unless the sensor 8 is arranged at the position where skewing of the transported recording medium P is accumulated.

The sensor 8*a* and the sensor 8*b* of the present embodiment have the same configuration. However, the sensors 8*a* and 8*b* may be configured as different speed sensors.

In the state of FIG. 16A, there is no difference between the speed of transport of the recording medium P detected by the sensor 8*a* and the speed of transport of the recording medium P detected by the sensor 8*b*. Thus, the control unit 23 determines that there is no speed difference on the basis of the speeds detected by the sensor 8*a* and the sensor 8*b*.

Meanwhile, in the state of FIG. 16B, the speed of transport of the recording medium P detected by the sensor 8*a* is higher than the speed of transport of the recording medium P detected by the sensor 8*b*. Since the speed of transport of the recording medium P detected by the sensor 8*a* is higher, the amount of transport is greater on the sensor 8*a* side of the recording medium P than on the sensor 8*b* side thereof, and the recording medium P is transported askew to the sensor 8*b* side thereof while advancing downstream of the transport direction A. Thus, the control unit 23 determines that there is a speed difference on the basis of the speeds detected by the sensor 8*a* and the sensor 8*b* and that the speed of transport of the recording medium P is higher on the sensor 8*a* side thereof in the intersecting direction B.

Each of the sensor 8*a* and the sensor 8*b* of the present embodiment emits electromagnetic waves (light) to the recording medium P and receives electromagnetic waves reflected by the recording medium P to obtain the speed of transport of the recording medium P from a frequency change due to the Doppler effect.

The speed sensor obtaining the speed of transport of the recording medium P from a frequency change due to the Doppler effect may have different detected speed values (values of absolute speed) depending on the type of the recording medium P. This is because the state of scattered light reflected by the recording medium P changes when the type of the recording medium P is changed. When such a speed sensor employs the detected speed value to obtain the state of skewing of the recording medium P, it may be difficult to accurately detect the state of skewing because detection is affected by the type of the recording medium P.

Meanwhile, as described above, the recording apparatus 1 of the present embodiment obtains a speed difference on the basis of the speeds detected by the sensor 8*a* and the sensor 8*b* to detect the state of skewing of the recording medium P from the speed difference. Therefore, the amount of change between the speeds detected by the sensor 8*a* and the sensor 8*b* depending on the type of the recording medium P can be counterbalanced, and thus the state of skewing can be accurately detected.

While each of the sensor 8*a* and the sensor 8*b* of the present embodiment is configured to emit electromagnetic waves to the recording medium P and to receive electromagnetic waves reflected by the recording medium P, the sensors 8*a* and 8*b* may be configured to emit sonic waves to the recording medium P and to receive sonic waves reflected by the recording medium P.

Preferred examples of the speed sensor capable of obtaining the speed of transport of the recording medium P from a frequency change due to the Doppler effect will be specifically described hereafter.

A first example is configured to emit two rays of irradiation light from the upstream side and the downstream side of the recording medium P in the transport direction A and to receive reflective light (scattered light) from the recording medium P based on each irradiation light in one light receiving unit. The scattered light includes speed information about the recording medium P in the transport direction A in the form of a change in the wavelength of light. The scattered light originating from the upstream side irradiation light has a long wavelength while the scattered light originating from the downstream side irradiation light has a short wavelength. Therefore, the speed of transport of the recording medium P can be obtained by detecting wavelengths in the heterodyne detection of a wavelength difference between both of these wavelengths.

A second example is configured to irradiate the recording medium P moving in the transport direction A with irradiation light from a laser and to receive scattered light (returning light) having a wavelength changed after being reflected by the recording medium P with the laser. The output of the laser slightly increases when the phase of the irradiation light matches that of the returning light at the time of the return of the returning light to the laser, and by employing the phenomenon of the increase, the speed of transport of the recording medium P can be obtained.

The sensor 8*a* and the sensor 8*b* of the present embodiment have the same configuration as the first example.

It is also possible to employ a sensor further different from the above sensor. As a sensor further different from the above sensor, for example, a motion sensor including a plurality of light emitting units and one light receiving unit can be employed to detect the end portions of the recording medium P.

Figure 17:
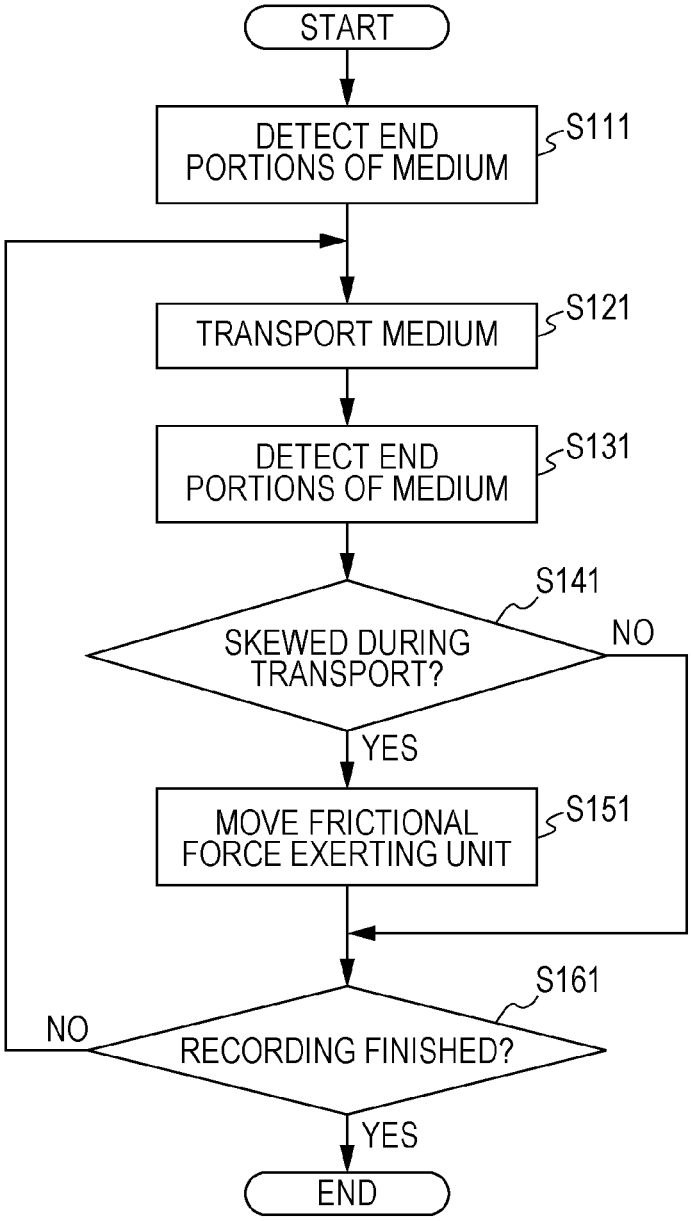
FIG. 17 is a flowchart of a recording method according to one embodiment of the invention.

Embodiment of Recording Method (FIG. 17)

Next, a recording method according to one embodiment will be described by employing FIG. 17.

The recording method of the present embodiment is one embodiment of the recording method performed by employing the recording apparatus 1 of the first embodiment. However, a recording method employing the recording apparatus 1 of any of the second to fourth embodiments can also be performed in the same manner as the recording method of the present embodiment.

When the recording method of the present embodiment starts with the recording data input from the PC 20, first, in step S111, the sensor 8 detects the positions of both end portions of the recording medium P in the intersecting direction B under control of the control unit 23.

Next, in step S121, the recording medium P is transported to a predetermined position. The transport of the recording medium P in the present step corresponds to either transport of the recording medium P to a recording start position or one instance of transport in the intermittent transport of the recording medium P.

After transport of the recording medium P is finished in step S121, in step S131, the sensor 8 detects the positions of both end portions of the recording medium P in the intersecting direction B under control of the control unit 23.

Next, in step S141, the control unit 23 determines whether or not the recording medium P is skewed during transport thereof on the basis of the result of detection of the positions of both end portions of the recording medium P in the intersecting direction B by the sensor 8 before and after the transport of the medium in step S121.

When the control unit 23 determines that the recording medium P is skewed during transport thereof in the present step, the recording method proceeds to step S151. Meanwhile, when the control unit 23 determines that the recording medium P is not skewed during transport thereof, the recording method proceeds to step S161.

In step S151, the control unit 23 determines which one of the elevating unit 35*a* side and the elevating unit 35*b* side of the frictional force exerting unit 61 to bring into contact with the recording medium P according to the direction of the recording medium P skewed during transport thereof detected by the sensor 8 and controls the attitude of the frictional force exerting unit 61 on the basis of the determination result.

Specifically, when the recording medium P is transported askew toward the elevating unit 35*b* while advancing downstream of the transport direction A as illustrated in FIGS. 10A and 10B, the recording apparatus 1 of the present embodiment controls the frictional force exerting unit 61 so that the elevating unit 35*a* side of the frictional force exerting unit 61 comes into contact with the recording medium P. When the recording medium P is transported askew toward the elevating unit 35*a* while advancing downstream of the transport direction A as illustrated in FIGS. 11A and 11B, the recording apparatus 1 of the present embodiment controls the frictional force exerting unit 61 so that the elevating unit 35*b* side of the frictional force exerting unit 61 comes into contact with the recording medium P.

In step S161, the control unit 23 controls recording on the basis of the recording data input from the PC 20 and determines whether or not the recording based on the recording data is finished.

The recording method of the present embodiment ends when the control unit 23 determines that recording is finished in the present step. Meanwhile, when the control unit 23 determines that recording is not finished in the present step, the recording method returns to step S121 and repeats step S121 to step S161.

While the frictional force exerting unit 61 is moved when the recording medium P stops during the intermittent transport of the recording medium P in step S151, the frictional force exerting unit 61 may be moved when the recording medium P moves during the intermittent transport of the recording medium P or when the recording medium P moves during continuous transport of the recording medium P.

As in the recording method of the present embodiment, recording can be performed while skewing of the recording medium P is prevented during transport thereof without damaging the recording side 16 of the recording medium P by controlling the contact of the frictional force exerting unit 61, which is capable of coming into contact with and separating from the side 17 of the recording medium P opposite to the recording side 16 and capable of coming into contact with at least a part in the intersecting direction B of the side 17 of the recording medium P opposite to the recording side 16 when the recording medium P is transported by the transporting unit 9 to exert frictional force on the recording medium P differently in the intersecting direction B, with the recording medium P on the basis of the detection result from the sensor 8 and transporting the recording medium P to perform recording on the recording medium P.

Hereinafter, a recording apparatus according to one embodiment of the invention will be described in detail with reference to the appended drawings. Constituent members of the present embodiment common to the first embodiment will be designated by the same reference sign and will not be described in detail.

Sixth Embodiment

FIG. 18 to FIG. 22C

Figure 18:
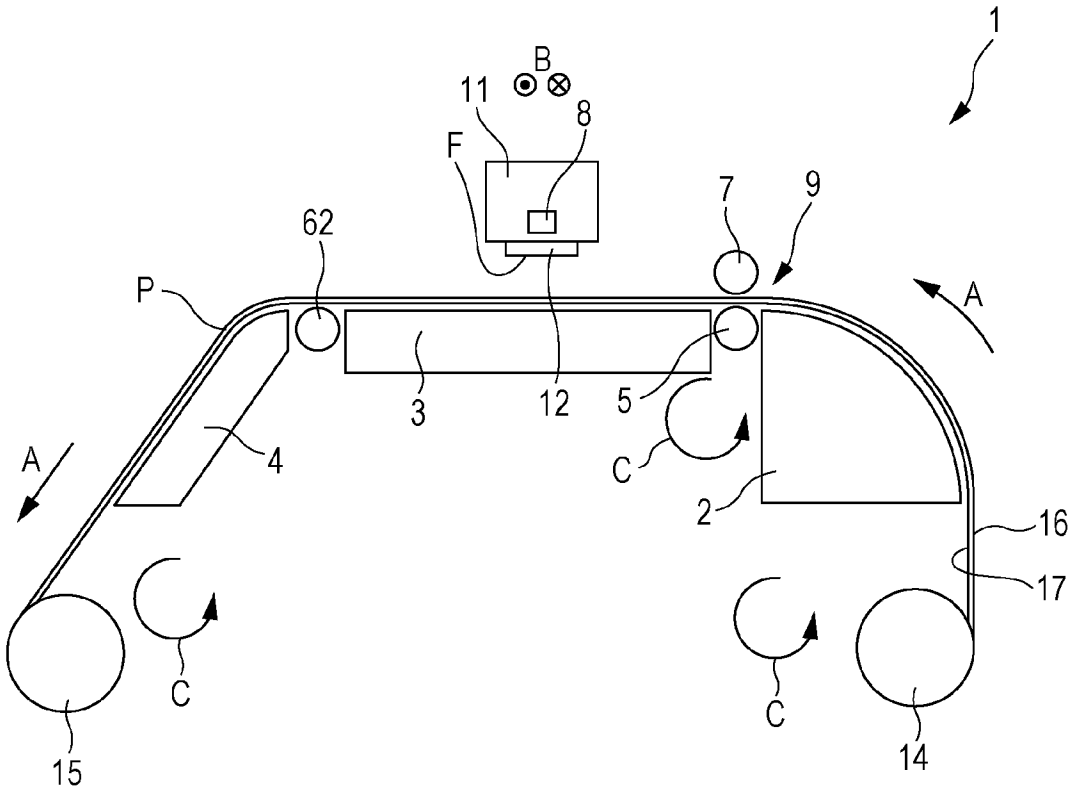
FIG. 18 is a schematic side view illustrating a recording apparatus according to a sixth embodiment of the invention.
Figure 19:
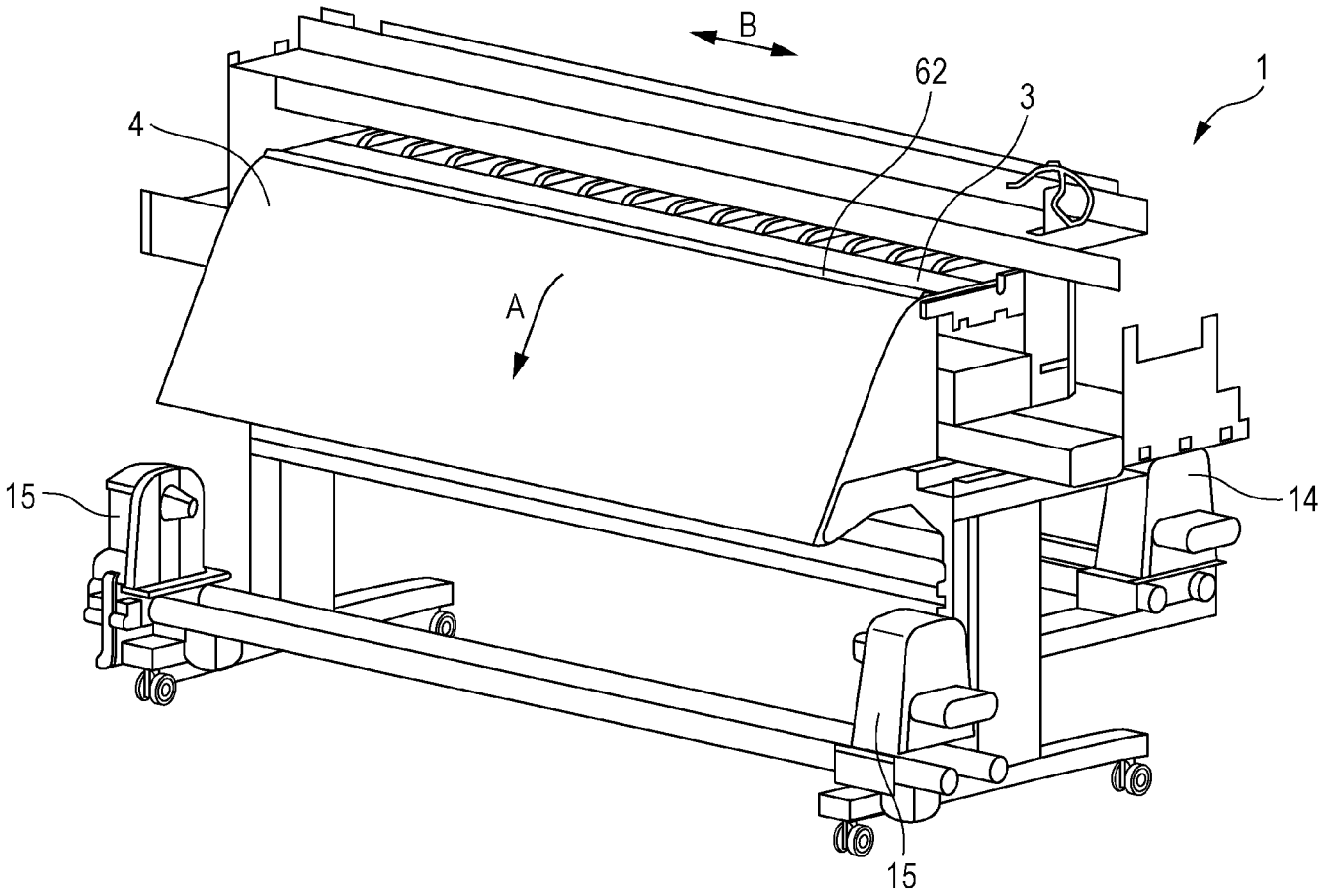
FIG. 19 is a schematic perspective view illustrating the recording apparatus according to the sixth embodiment of the invention.

FIG. 18 is a schematic side view illustrating the recording apparatus 1 of the present embodiment, and FIG. 19 is a schematic perspective view illustrating the recording apparatus 1 of the present embodiment. A part of the constituent members of the recording apparatus 1 such as a casing unit is not illustrated in FIG. 18 and FIG. 19. Particularly, the carriage 11 is not illustrated in FIG. 19 so that the rotating object 62 constituting a main portion of the present embodiment and capable of adjusting the direction of transport of the medium can be easily seen.

The recording apparatus 1 of the present embodiment includes the rotating object 62 on the downstream side of the recording head 12 in the transport direction A on the transport path of the recording medium P. The rotating object 62 is a roller including a rotating shaft in the intersecting direction B. The rotating object 62 is arranged at a position between the platen 3 and the platen 4 where the rotating object 62 can come into contact with the side 17 of the recording medium P opposite to the recording side 16 on which recording is performed by the recording head 12.

The rotating object 62 will be described in detail hereafter.

Figure 20A:
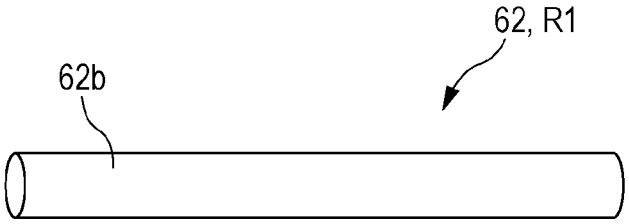
FIGS. 20A to 20C are schematic diagrams illustrating a main portion of the recording apparatus according to the sixth embodiment of the invention.
Figure 20B:
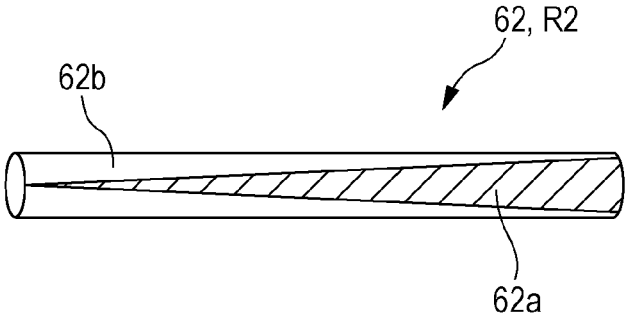
Figure 20C:
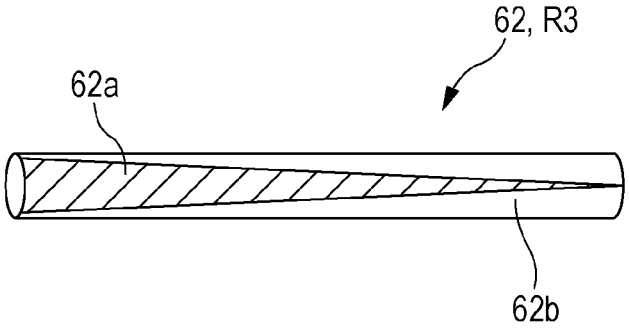

FIGS. 20A to 20C are schematic diagrams of the rotating object 62 constituting a main portion of the recording apparatus 1 of the present embodiment.

The rotating object 62 of the present embodiment is a cylindrically shaped roller and has a circumferential face divided into three regions R1, R2, and R3 as regions contactable by the recording medium P. The recording apparatus 1 of the present embodiment can bring one of the regions R1, R2, and R3 into contact with the side 17 of the recording medium P by rotating the rotating object 62 in the rotational direction C to change the position of the circumferential face thereof.

FIG. 20A illustrates the region R1 as the contactable region of the rotating object 62. FIG. 20B illustrates the region R2 as the contactable region of the rotating object 62. FIG. 20C illustrates the region R3 as the contactable region of the rotating object 62.

The left-right direction of FIGS. 20A to 20C (longitudinal direction of the rotating object 62) is a direction corresponding to the intersecting direction B when the rotating object 62 is attached to the recording apparatus 1.

As illustrated in FIG. 20A, the region R1 is configured of one region 62*b*. Thus, when the recording medium P transported comes into contact with the rotating object 62 in the region R1, frictional force is evenly applied in the left-right direction of FIG. 20A.

As illustrated in FIG. 20B, the region R2 is configured of two regions 62*a* and 62*b*. The region 62*a* is configured to have a higher coefficient of friction against the recording medium P than the region 62*b*. Thus, when the recording medium P transported comes into contact with the rotating object 62 in the region R2, frictional force is applied more greatly on the right side of the recording medium P in the left-right direction of FIG. 20B.

While there is no particular limitation on how to configure the region 62*a* to have a higher coefficient of friction against the recording medium P than the region 62*b*, the regions 62*a* and 62*b* can be configured of different materials. Alternatively, the region 62*a* and the region 62*b* can be configured to have minute roughness elements disposed thereon at different roughness densities.

As illustrated in FIG. 20C, the region R3 is also configured of two regions 62*a* and 62*b* like the region R2. Since the region 62*a* is configured to have a higher coefficient of friction against the recording medium P than the region 62*b*, when the recording medium P transported comes into contact with the rotating object 62 in the region R3, frictional force is applied more greatly on the left side of the recording medium P in the left-right direction of FIG. 20C in opposition to the case of the recording medium P coming into contact with the region R2.

As such, the rotating object 62 of the present embodiment includes the contactable region R2 having a coefficient of friction against the recording medium P increasing from one side to the other side of the rotating object 62 in the intersecting direction B and the contactable region R3 having a coefficient of friction against the recording medium P decreasing from the one side to the other side. In addition, since the rotating object 62 includes the rotating shaft in the intersecting direction B, rotation of the rotating object 62 in the rotational direction C can simply change the contact region of the rotating object 62 coming into contact with the recording medium P to any of the regions R1, R2, and R3. In addition, the rotating object 62, since disposed at a position coming into contact with the side 17 of the recording medium P opposite to the recording side 16, does not damage the recording side 16 of the recording medium P.

In the above description, the correspondence between the one side and the other side and between the contactable regions R2 and R3 may be reversed.

Next, an electrical configuration of the recording apparatus 1 of the present embodiment will be described.

Figure 21:
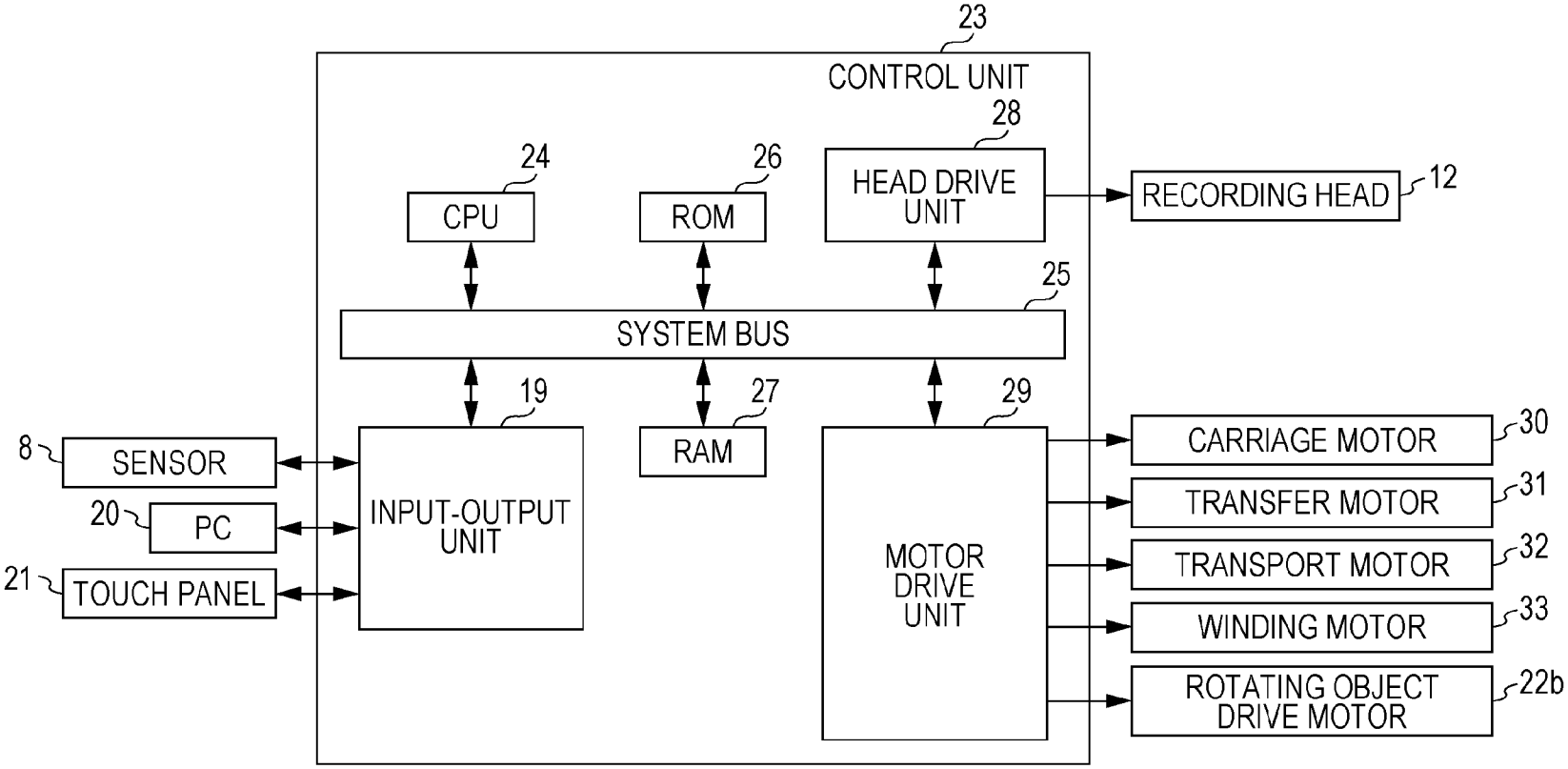
FIG. 21 is a block diagram of the recording apparatus according to the sixth embodiment of the invention.

FIG. 21 is a block diagram of the recording apparatus 1 of the present embodiment.

The CPU 24 is connected, through the system bus 25, to the carriage motor 30 intended to move the carriage 11, the transfer motor 31 as a drive source of the setting unit 14, the transport motor 32 as a drive source of the driving roller 5, the winding motor 33 as a drive source of the winding unit 15, and the motor drive unit 29 intended to drive a rotating object drive motor 22*b* capable of rotating and moving the rotating object 62 in the rotational direction C.

The control unit 23 of the present embodiment, with such a configuration, can set (change) the contact region of the rotating object 62 coming into contact with the side 17 of the recording medium P opposite to the recording side 16 to one of the regions R1, R2, and R3 on the basis of the detection result from the sensor 8.

As such, the recording apparatus 1 of the present embodiment includes the rotating object 62 that includes the contactable region R2 (R3) having a coefficient of friction against the recording medium P increasing from one side to the other side of the rotating object 62 in the intersecting direction B as well as the contactable region R3 (R2) having a coefficient of friction against the recording medium P decreasing from the one side to the other side and that is capable of coming into contact with the side 17 of the recording medium P opposite to the recording side 16. In addition, the recording apparatus 1 includes the control unit 23 that controls the rotating object 62 on the basis of the detection result from the sensor 8 to set the contact region of the rotating object 62 coming into contact with the recording medium P to one of the regions R1, R2, and R3. Thus, since the contact regions of the rotating object can be set to have different frictional force distributions depending on the direction of the recording medium P skewed during transport thereof, the recording apparatus 1 is configured to be capable of preventing skewing of the transported recording medium P without damaging the recording side 16 of the recording medium P.

While the rotating object 62 of the present embodiment is disposed between the platen 3 and the platen 4, the position where the rotating object 62 is disposed is not particularly limited. However, as in the recording apparatus 1 of the present embodiment, it is preferable to dispose the rotating object 62 at a position where the area of contact between the rotating object 62 and the recording medium P is as great as possible.

As described above, the rotating object 62 of the present embodiment includes the contactable region R2 (R3) having a coefficient of friction against the recording medium P increasing from one side to the other side of the rotating object 62 in the intersecting direction B and the contactable region R3 (R2) having a coefficient of friction against the recording medium P decreasing from the one side to the other side of the rotating object 62 in the intersecting direction B.

However, instead of the rotating object 62 of the present embodiment, it is also possible to employ the rotating object 62 including the contactable region R2 (R3) having an area of contact with the recording medium P increasing from one side to the other side of the rotating object 62 in the intersecting direction B and the contactable region R3 (R2) having an area of contact with the recording medium P decreasing from the one side to the other side. Specifically, for example, the regions R2 and R3 may be formed by configuring the rotating object 62 such that the region 62*a* is convex compared with the region 62*b* in FIGS. 20A to 20C. With such a configuration, only the region 62*a* comes into contact with the recording medium P in the regions R2 and R3, and the left side of FIG. 20B has a greater area of contact with the recording medium P in the region R2 illustrated in FIG. 20B while the right side of FIG. 20C has a greater area of contact with the recording medium P in the region R3 illustrated in FIG. 20C.

Even by employing the rotating object 62 configured as such, the control unit 23, as in the recording apparatus 1 of the present embodiment, can set (change) one of the contact regions of the rotating object having different frictional force distributions depending on the direction of the recording medium P skewed during transport thereof. Thus, skewing of the transported recording medium P can be prevented without damaging the recording side 16 of the recording medium P.

While the recording apparatus 1 of the present embodiment includes three types of contactable regions of the regions R1, R2, and R3, the recording apparatus 1 is not limited such a configuration. For example, the recording apparatus 1 may be configured to include four or more types of contactable regions. Alternatively, with two types of contactable regions of the regions R2 and R3, the control unit 23 may be configured to control changing the position of the rotating object 62 so that the rotating object 62 does not come into contact with the recording medium P when the recording medium P is not skewed during transport thereof.

While the rotating object 62 of the present embodiment is disposed between the platen 3 and the platen 4, the position where the rotating object 62 is disposed is not particularly limited.

Next, the specific content of control performed by the control unit 23 on the rotating object 62 when the recording medium P is skewed during transport thereof in the recording apparatus 1 of the present embodiment, that is, setting the contact regions of the rotating object 62 coming into contact with the recording medium P will be described.

Figure 22A:
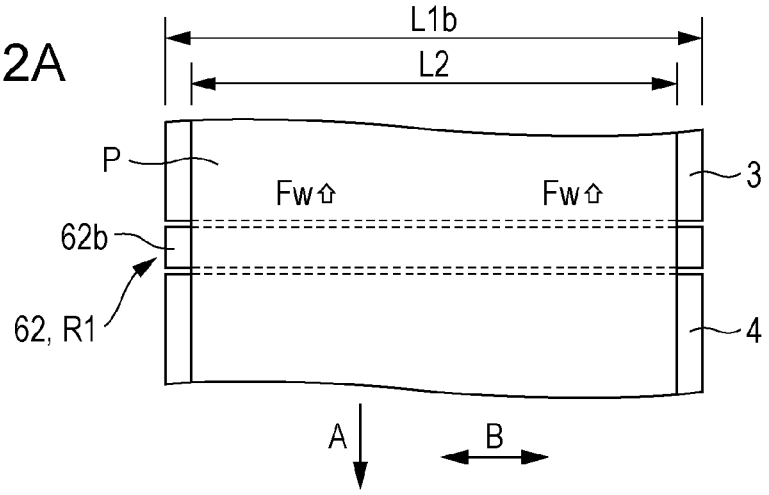
FIGS. 22A to 22C are schematic plan views illustrating a main portion of the recording apparatus according to the sixth embodiment of the invention.
Figure 22B:
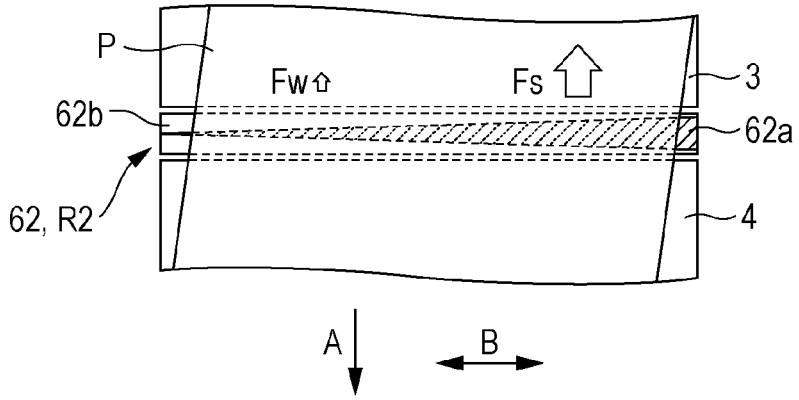
Figure 22C:
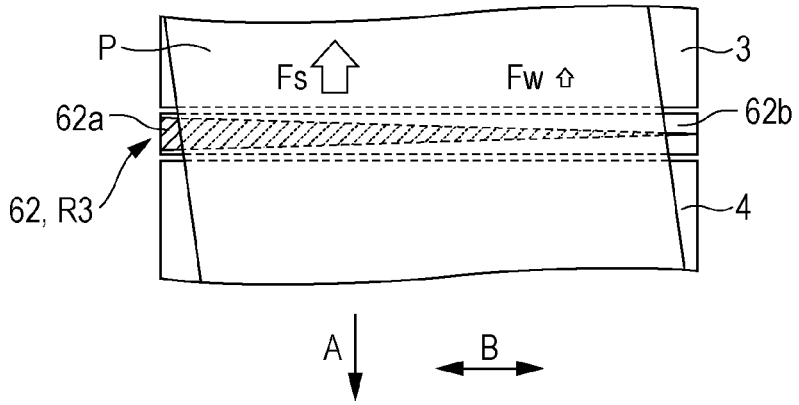

FIGS. 22A to 22C are schematic plan views illustrating the rotating object 62 constituting a main portion of the recording apparatus 1 of the present embodiment and the surroundings thereof. FIG. 22A illustrates a state where the recording medium P is not skewed during transport thereof in the recording apparatus 1 of the present embodiment. FIG. 22B illustrates a state where the recording medium P is transported askew to the left side of FIG. 22B while advancing downstream of the transport direction A in the recording apparatus 1 of the present embodiment. FIG. 22C illustrates a state where the recording medium P is transported askew to the right side of FIG. 22C while advancing downstream of the transport direction A in the recording apparatus 1 of the present embodiment.

The sensor 8 of the present embodiment is disposed in the carriage 11 and is capable of detecting both end portions in the intersecting direction B of the recording medium P. Thus, the end portions can be detected along with the discharge operation before and after the transport operation. Therefore, from the positions of the end portions detected before and after the transport operation, the control unit 23 can determine whether or not the recording medium P is skewed during transport thereof as well as whether the recording medium P is transported askew to the left side of FIG. 22A to 22C or the recording medium P is transported askew to the right side thereof.

As illustrated in FIG. 22A, when the recording medium P is not skewed during transport thereof, the recording apparatus 1 of the present embodiment sets the contact region of the rotating object 62 coming into contact with the recording medium P to the region R1 under control of the control unit 23. The region R1 is configured of only the region 62*b*. Thus, in this state, frictional force applied to the recording medium P is even at the left and right of the recording medium P when viewed from the transport direction A, thereby maintaining the state where the recording medium P is not skewed during transport thereof.

The frictional force that the region 62*b* exerts on the recording medium P in the opposite direction to the transport direction A is illustrated as a weak frictional force Fw.

As illustrated in FIG. 22A, a length L1*b* of the rotating object 62 in the intersecting direction B in the recording apparatus 1 of the present embodiment is greater than or equal to the length (width) L2 of the recording medium P in the intersecting direction B. In other words, the length L1*b* of the rotating object 62 in the intersecting direction B is greater than or equal to the length of transport of the recording medium P in the intersecting direction B on the transport path of the recording medium P. Thus, the rotating object 62 is configured to be capable of securely coming into contact with the recording medium P across the width direction of the recording medium P and capable of effectively preventing skewing of the transported recording medium P.

Meanwhile, as illustrated in FIG. 22B, when the recording medium P is transported askew to the left side of FIG. 22B while advancing downstream of the transport direction A, the recording apparatus 1 of the present embodiment sets the contact region of the rotating object 62 coming into contact with the recording medium P to the region R2 under control of the control unit 23. The frictional force that the region 62*a* exerts on the recording medium P in the opposite direction to the transport direction A is illustrated as a strong frictional force Fs that is stronger than the frictional force exerted by the region 62*b* on the recording medium P. Thus, in this state, frictional force exerted on the recording medium P in the opposite direction to the transport direction A is greater on the right side of FIG. 22B than on the left side thereof. That is, a force pulling the recording medium P upstream of the transport direction A is more strongly applied on the right side of FIG. 22B than on the left side thereof. When such a force is applied to the recording medium P, the amount of transport is greater on the left side of FIG. 22B than on the right side thereof during the transport operation, thereby alleviating skewing of the transported recording medium P.

Meanwhile, as illustrated in FIG. 22C, when the recording medium P is transported askew to the right side of FIG. 22C while advancing downstream of the transport direction A, the recording apparatus 1 of the present embodiment sets the contact region of the rotating object 62 coming into contact with the recording medium P to the region R3 under control of the control unit 23. Thus, in this state, frictional force exerted on the recording medium P in the opposite direction to the transport direction A is greater on the left side of FIG. 22C than on the right side thereof. That is, a force pulling the recording medium P upstream of the transport direction A is more strongly applied on the left side of FIG. 22C than on the right side thereof. When such a force is applied to the recording medium P, the amount of transport is greater on the right side of FIG. 22C than on the left side thereof during the transport operation, thereby alleviating skewing of the transported recording medium P.

Seventh Embodiment

Figure 23A:
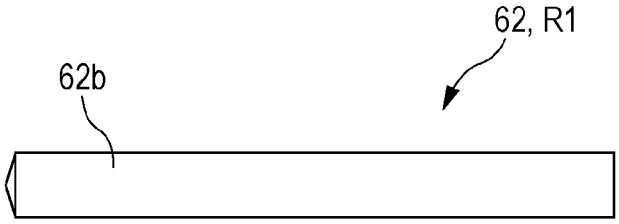
FIGS. 23A to 23C are schematic diagrams illustrating a main portion of a recording apparatus according to a seventh embodiment of the invention.
Figure 23B:
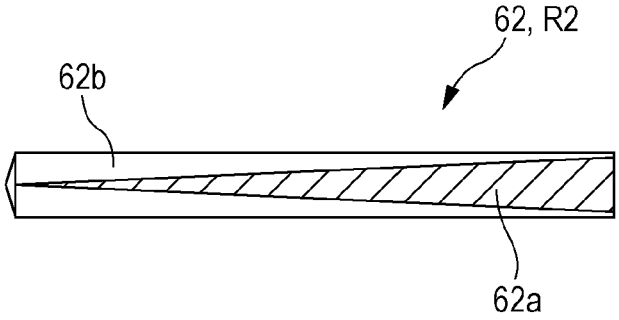
Figure 23C:
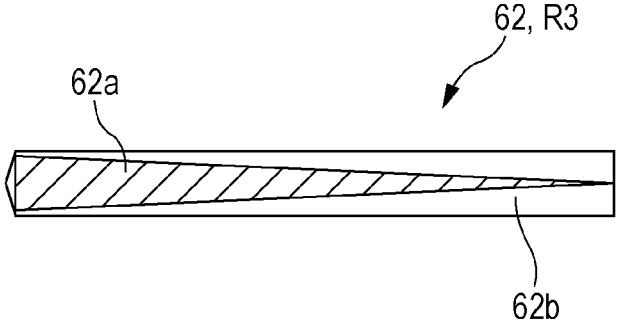

FIGS. 23A to 23C

Next, a recording apparatus of a seventh embodiment will be described in detail with reference to the appended drawings.

FIGS. 23A to 23C are schematic diagrams of the rotating object 62 constituting a main portion of the recording apparatus 1 of the present embodiment and are diagrams corresponding to FIGS. 20A to 20C of the recording apparatus 1 of the sixth embodiment. Constituent members of the present embodiment common to the sixth embodiment will be designated by the same reference sign and will not be described in detail.

The recording apparatus 1 of the present embodiment has the same configuration as the recording apparatus 1 of the sixth embodiment except for the configuration of the rotating object 62.

The rotating object 62 of the sixth embodiment is configured as a cylindrically shaped roller having a circumferential face where the regions R1, R2, and R3 are disposed as contactable regions.

Meanwhile, the rotating object 62 of the present embodiment is configured as a rotating object shaped as a triangular column and having a side face where the regions R1, R2, and R3 are disposed as contactable regions.

FIG. 23A illustrates, as the region R1, one side face of the rotating object 62 shaped as a triangular column. The region R1 is configured of one region 62*b*. Thus, when the recording medium P transported comes into contact with the rotating object 62 in the region R1, frictional force is evenly applied in the left-right direction of FIG. 23A.

FIG. 23B illustrates, as the region R2, one side face of the rotating object 62 shaped as a triangular column. The region R2 is configured of two regions 62*a* and 62*b*. As in the rotating object 62 of the sixth embodiment, the region 62*a* is configured to have a higher coefficient of friction against the recording medium P than the region 62*b*. Thus, when the recording medium P transported comes into contact with the rotating object 62 in the region R2, frictional force is applied more greatly on the right side of the recording medium P in the left-right direction of FIG. 23B.

FIG. 23C illustrates, as the region R3, one side face of the rotating object 62 shaped as a triangular column. The region R3 is also configured of two regions 62*a* and 62*b* like the region R2. Since the region 62*a* is configured to have a higher coefficient of friction against the recording medium P than the region 62*b*, when the recording medium P transported comes into contact with the rotating object 62 in the region R3, frictional force is applied more greatly on the left side of the recording medium P in the left-right direction of FIG. 23C in opposition to the case of the recording medium P coming into contact with the region R2.

From the above description, it is understood that the recording apparatus 1 of the present embodiment has the same effect as the recording apparatus 1 of the sixth embodiment.

A cylindrically shaped rotating object such as the rotating object 62 of the sixth embodiment is advantageous over a rotating object shaped as a polygonal column such as the rotating object 62 of the present embodiment in that the rotating object 62 moves more smoothly when the contact region is changed, thereby not imparting vibrations to the recording medium P.

Eighth Embodiment

Figure 24A:
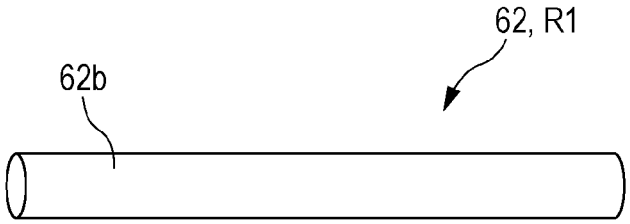
FIGS. 24A to 24C are schematic diagrams illustrating a main portion of a recording apparatus according to an eighth embodiment of the invention.
Figure 24B:
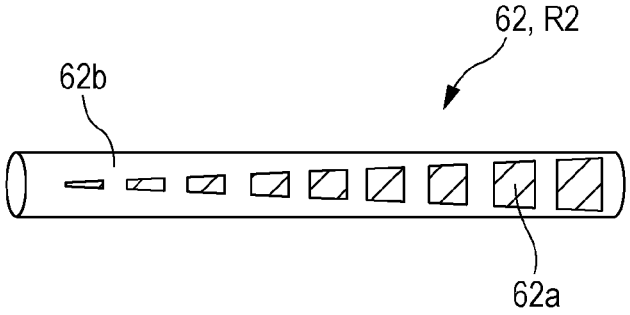
Figure 24C:
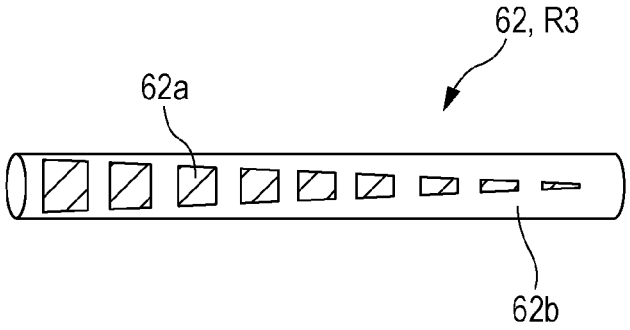

FIGS. 24A to 24C

Next, a recording apparatus of an eighth embodiment will be described in detail with reference to the appended drawings.

FIGS. 24A to 24C are schematic diagrams of the rotating object 62 constituting a main portion of the recording apparatus 1 of the present embodiment and are diagrams corresponding to FIGS. 20A to 20C of the recording apparatus 1 of the sixth embodiment. Constituent members of the present embodiment common to the sixth and seventh embodiments will be designated by the same reference sign and will not be described in detail.

The recording apparatus 1 of the present embodiment has the same configuration as the recording apparatus 1 of the sixth embodiment except for the configuration of the rotating object 62.

The rotating object 62 of the sixth embodiment is configured as a cylindrically shaped roller having a circumferential face where the regions R1, R2, and R3 are disposed as contactable regions. The regions R2 and R3 are configured to include the region 62*b* where the regions 62*a* of which the area continuously changes in the longitudinal direction of the rotating object 62 (region having a higher coefficient of friction against the recording medium P than the region 62*b*) are disposed so that frictional force continuously changes in the longitudinal direction corresponding to the intersecting direction B.

The rotating object 62 of the present embodiment configured as a cylindrically shaped roller having a circumferential face where the regions R1, R2, and R3 are disposed as contactable regions is the same as the rotating object 62 of the sixth embodiment. However, the regions R2 and R3 are configured to include the region 62*b* where a plurality of regions 62*a* of which the area continuously changes in order in the longitudinal direction is lined up at intervals so that frictional force continuously changes in the longitudinal direction.

The region R1 illustrated in FIG. 24A is configured of one region 62*b* like the region R1 of the rotating object 62 of the sixth embodiment. Thus, when the recording medium P transported comes into contact with the rotating object 62 in the region R1, frictional force is evenly applied in the left-right direction of FIG. 24A.

The region R2 illustrated in FIG. 24B is configured of two types of regions 62*a* and 62*b*. As in the rotating object 62 of the sixth embodiment, the region 62*a* is configured to have a higher coefficient of friction against the recording medium P than the region 62*b*. The area of the plurality of regions 62*a* increases to the right side of FIG. 24B. Thus, when the recording medium P transported comes into contact with the rotating object 62 in the region R2, frictional force is applied more greatly on the right side of the recording medium P in the left-right direction of FIG. 24B.

The region R3 illustrated in FIG. 24C is configured of two types of regions 62*a* and 62*b* like the region R2. The area of the plurality of regions 62*a* increases to the left side of FIG. 24C. Thus, when the recording medium P transported comes into contact with the rotating object 62 in the region R3, frictional force is applied more greatly on the left side of the recording medium P in the left-right direction of FIG. 24C. The shape of the plurality of regions 62*a* can be, for example, a trapezoid, an oblong, or an ellipse. Alternatively, the regions 62*a* may be configured as an aggregate of a minute square, an oblong, a circle, and an ellipse. The number of regions 62*a* coming into contact with the recording medium P may be changed by configuring the lengths of the plurality of regions 62*a* to be different in the rotational direction of the rotating object 62. Accordingly, load can be reduced during transport of the recording medium P.

From the above description, it is understood that the recording apparatus 1 of the present embodiment has the same effect as the recording apparatus 1 of the sixth and seventh embodiments.

Ninth Embodiment

FIG. 25

Next, a recording apparatus of a ninth embodiment will be described in detail with reference to the appended drawings.

Figure 25:
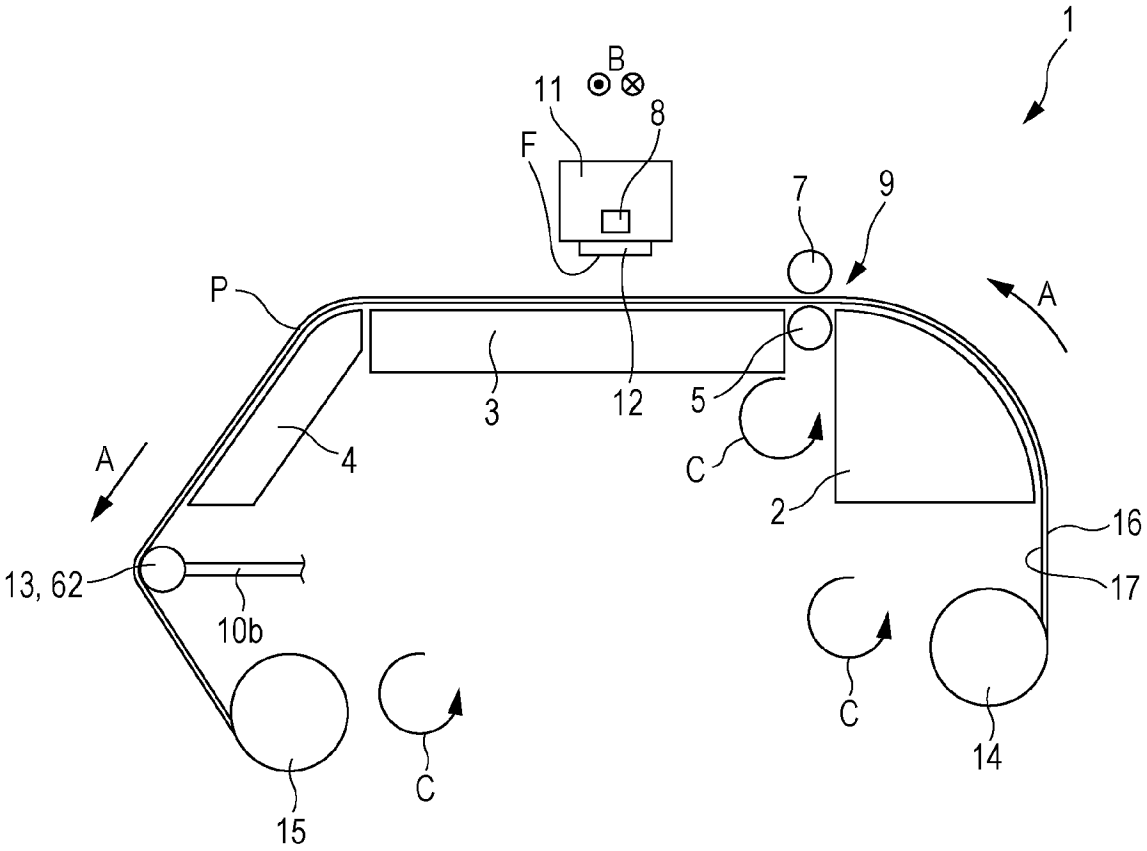
FIG. 25 is a schematic side view illustrating a recording apparatus according to a ninth embodiment of the invention.

FIG. 25 is a schematic side view of the recording apparatus 1 of the present embodiment and is a diagram corresponding to FIG. 18 of the recording apparatus 1 of the sixth embodiment. Constituent members of the present embodiment common to the sixth to eighth embodiments will be designated by the same reference sign and will not be described in detail.

The recording apparatus 1 of the present embodiment has the same configuration as the recording apparatus 1 of the sixth embodiment except for including a tensile force generating unit 10*b* exerting tensile force on the recording medium P transported in the transport direction A so as to increase the ability of the winding unit 15 to wind the recording medium P as well as the rotating object 62 disposed in the tensile force generating unit 10*b*.

The rotating object 62 of the sixth embodiment is disposed between the platen 3 and the platen 4.

Meanwhile, the rotating object 62 of the present embodiment is disposed in a contact unit 13 contactable by the side 17 of the recording medium P across the intersecting direction B in the tensile force generating unit 10*b* exerting tensile force on the recording medium P transported in the transport direction A. The rotating object 62 of the present embodiment also has the same configuration as the rotating object 62 of the sixth embodiment.

In other words, the recording apparatus 1 of the present embodiment includes a rotating object having the same configuration as the rotating object 62 of the sixth embodiment disposed in the contact unit 13 in the tensile force generating unit 10*b* that is disposed further downstream of the transport direction A than the recording head 12 and that comes into contact with the recording medium P at the contact unit 13 across the intersecting direction B to exert tensile force on the recording medium P. Thus, the tensile force generating unit 10*b* has the function of preventing skewing of the transported medium P as well, and this can reduce the necessity of configuring the rotating object separately from the tensile force generating unit 10*b*, thereby simplifying the recording apparatus 1 and reducing cost.

The meaning of the expression "comes into contact with the recording medium P at the contact unit 13 across the intersecting direction B" includes a case where a part of the tensile force generating unit 10*b* does not come into contact with the recording medium P in the intersecting direction B.

Figure 26:
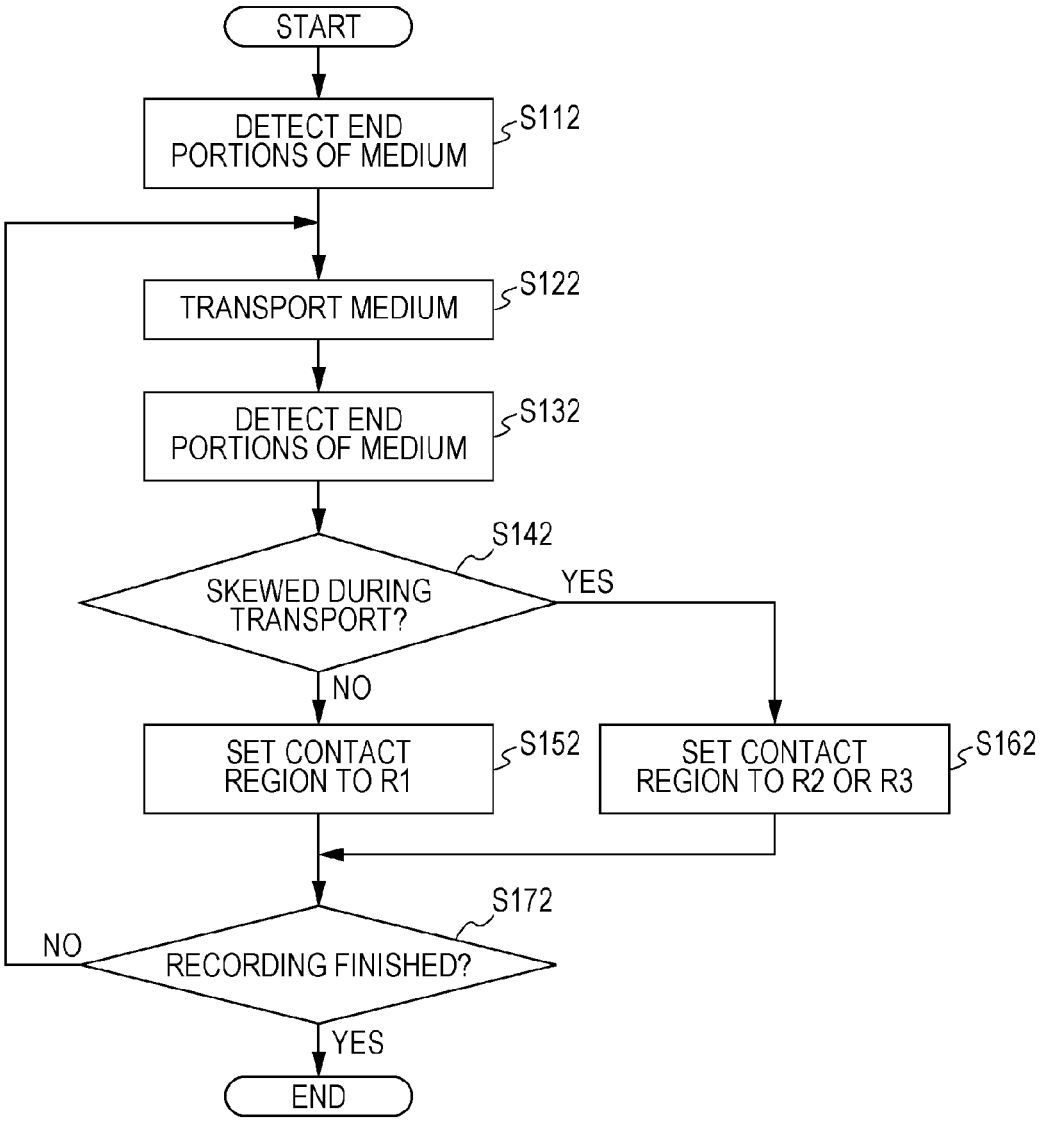
FIG. 26 is a flowchart of a recording method according to another embodiment of the invention.

Embodiment of Recording Method (FIG. 26)

Next, a recording method according to one embodiment will be described by employing FIG. 26.

The recording method of the present embodiment is one embodiment of the recording method performed by employing the recording apparatus 1 of the sixth embodiment. However, a recording method employing the recording apparatus 1 of any of the seventh to ninth embodiments can also be performed in the same manner as the recording method of the present embodiment.

When the recording method of the present embodiment starts with the recording data input from the PC 20, first, in step S112, the sensor 8 detects the positions of both end portions of the recording medium P in the intersecting direction B under control of the control unit 23.

Next, in step S122, the recording medium P is transported to a predetermined position. The transport of the recording medium P in the present step corresponds to either transport of the recording medium P to the recording start position or one instance of transport in the intermittent transport of the recording medium P.

After transport of the recording medium P is finished in step S122, in step S132, the sensor 8 detects the positions of both end portions of the recording medium P in the intersecting direction B under control of the control unit 23.

Next, in step S142, the control unit 23 determines whether or not the recording medium P is skewed during transport thereof on the basis of the result of detection of the positions of both end portions of the recording medium P in the intersecting direction B by the sensor 8 before and after the transport of the medium in step S122.

When the control unit 23 determines that the recording medium P is not skewed during transport thereof in the present step, the recording method proceeds to step S152. Meanwhile, when the control unit 23 determines that the recording medium P is skewed during transport thereof, the recording method proceeds to step S162.

In step S152, the control unit 23 controls the rotating object 62 such that the contact region of the rotating object 62 coming into contact with the recording medium P is set to the region R1 among the contactable regions of the regions R1, R2, and R3.

Meanwhile, in step S162, the control unit 23 controls the rotating object 62 such that the contact region of the rotating object 62 coming into contact with the recording medium P is set to either the region R2 or the region R3 among the contactable regions of the regions R1, R2, and R3.

Specifically, as illustrated in FIG. 22B, when the recording medium P is transported askew to the left side of FIG. 22B while advancing downstream of the transport direction A, the recording apparatus 1 of the present embodiment sets the contact region to the region R2. In addition, as illustrated in FIG. 22C, when the recording medium P is transported askew to the right side of FIG. 22C while advancing downstream of the transport direction A, the recording apparatus 1 of the present embodiment sets the contact region to the region R3.

After either step S152 or step S162 is finished, in step S172, the control unit 23 controls recording on the basis of the recording data input from the PC 20 and determines whether or not the recording based on the recording data is finished.

The recording method of the present embodiment ends when the control unit 23 determines that recording is finished in the present step. Meanwhile, when the control unit 23 determines that recording is not finished in the present step, the recording method returns to step S122 and repeats step S122 to step S172.

While the rotating object 62 is moved when the recording medium P stops during the intermittent transport of the recording medium P in step S162, the rotating object 62 may be moved when the recording medium P moves during the intermittent transport of the recording medium P or when the recording medium P moves during continuous transport of the recording medium P.

As in the recording method of the present embodiment, recording can be performed while skewing of the recording medium P is prevented during transport thereof without damaging the recording side 16 of the recording medium P by setting the contact region of the rotating object 62, which includes the contactable region R2 (R3) where the coefficient of friction against the recording medium P increases from one side to the other side of the rotating object 62 in the intersecting direction B as well as the contactable region R3 (R2) where the coefficient of friction against the recording medium P decreases from the one side to the other side and which is capable of coming into contact with the side 17 of the recording medium P opposite to the recording side 16, to one of the regions R1 to R3 on the basis of the detection result from the detecting unit 8 and by transporting the recording medium P to perform recording on the medium P.

Alternatively, recording can be performed while skewing of the recording medium P is prevented during transport thereof without damaging the recording side 16 of the recording medium P by setting the contact region of the rotating object 62, which includes the contactable region R2 (R3) where the area of contact with the recording medium P increases from one side to the other side of the rotating object 62 in the intersecting direction B as well as the contactable region R3 (R2) where the area of contact with the recording medium P decreases from the one side to the other side and which is capable of coming into contact with the side 17 of the recording medium P opposite to the recording side 16, to one of the region R1 where the area of contact with the recording medium P does not change from the one side to the other side, the region R2, and the region R3 on the basis of the detection result from the detecting unit 8 and by transporting the recording medium P to perform recording on the medium P.

The invention is not limited to the above embodiments. Various modifications can be carried out within the scope of the invention disclosed in the claims, and those modifications are to be regarded as falling within the scope of the invention, needless to say.

The invention has been described thus far on the basis of the specific embodiments. Below, the invention will be summarily described again.

The recording apparatus 1 in a first aspect of the invention is characterized by including the transporting unit 9 capable of transporting the medium P, the detecting unit 8 capable of detecting the transport direction A in which the medium P is transported by the transporting unit 9, the recording unit 12 capable of performing recording on the medium P transported by the transporting unit 9, the frictional force exerting unit 61 capable of coming into contact with and separating from the side 17 of the medium P opposite to the recording side 16 on which recording is performed by the recording unit 12 and capable of coming into contact with at least a part of the opposite side 17 of the medium P in the intersecting direction B intersecting with the transport direction A to exert frictional force on the medium P differently in the intersecting direction B when the medium P is transported by the transporting unit 9, and the control unit 23 controlling the contact of the frictional force exerting unit 61 with the medium P on the basis of a detection result from the detecting unit 8.

According to the present aspect, the recording apparatus 1 includes the frictional force exerting unit 61 capable of coming into contact with and separating from the opposite side 17 of the medium P and capable of coming into contact with at least a part of the opposite side 17 of the medium P in the intersecting direction B to exert frictional force on the medium P differently in the intersecting direction B when the medium P is transported by the transporting unit 9. In addition, the recording apparatus 1 includes the control unit 23 controlling the contact of the frictional force exerting unit 61 with the medium P on the basis of the detection result from the detecting unit 8. Thus, since frictional force can be adjusted in the intersecting direction B depending on the direction of the recording medium P skewed during transport thereof, the recording apparatus 1 can prevent skewing of the transported medium P without damaging the recording side 16 of the medium P.

The expression "capable of detecting the transport direction A" includes the meaning that, for example, detecting the positions of the end portions of the medium P in the intersecting direction B intersecting with the transport direction A or detecting the speed of transport of the medium P can result in the detection of the transport direction A.

The recording apparatus 1 in a second aspect of the invention is characterized in that the frictional force exerting unit 61 is an extending member extending in the intersecting direction B and that the control unit 23 is capable of controlling the contact region of the frictional force exerting unit 61 coming into contact with the medium P in the intersecting direction B by changing the angle between the medium P and the frictional force exerting unit 61 in the intersecting direction B viewed from the transport direction A.

According to the present aspect, the frictional force exerting unit 61 is an extending member extending in the intersecting direction B. In addition, the control unit 23 can control the contact region of the frictional force exerting unit 61 coming into contact with the medium P in the intersecting direction B by changing the angle between the medium P and the frictional force exerting unit 61 in the intersecting direction B viewed from the transport direction A. Thus, frictional force exerted on the medium P can be simply adjusted in the intersecting direction B by changing the angle between the medium P and the frictional force exerting unit 61 in the intersecting direction B viewed from the transport direction A.

The recording apparatus 1 in a third aspect of the invention, according to the second aspect, is characterized in that the frictional force exerting unit 61 is an extending member including the arc face 40 convex toward the opposite side 17 when viewed from the transport direction A.

According to the present aspect, the frictional force exerting unit 61 is an extending member including the arc face 40 convex toward the opposite side 17 when viewed from the transport direction A. Thus, when the contact region of the frictional force exerting unit 61 is controlled by changing the angle at which the frictional force exerting unit 61 is positioned, the area of contact between the frictional force exerting unit 61 and the opposite side 17 of the medium P can be increased. Thus, frictional force exerted on the medium P in the intersecting direction B can be efficiently adjusted.

The recording apparatus 1 in a fourth aspect of the invention, according to any one of the first to third aspects, is characterized by further including the moving object 11 moving together with the recording unit 12 in the intersecting direction B, in which the detecting unit 8 is disposed in the moving object 11.

According to the present aspect, the detecting unit 8 is disposed in the moving object 11 moving together with the recording unit 12 in the intersecting direction B. Thus, since the detecting unit 8 can simply detect the end portions of the medium P in the intersecting direction B, skewing of the transported medium P can be prevented in a case where either a continuous medium such as a roll-shaped medium or a cut medium is employed as the medium P.

The recording apparatus 1 in a fifth aspect of the invention, according to any one of the first to third aspects, is characterized in that the detecting unit 8 is disposed further upstream of the transport direction A than the recording unit 12.

According to the present aspect, the detecting unit 8 is disposed further upstream of the transport direction A than the recording unit 12. Thus, since skewing of the transported medium P can be detected before recording, it is possible to prevent degradation of the quality of an image recorded on the medium P.

The recording apparatus 1 in a sixth aspect of the invention, according to any one of the first to third aspects, is characterized by further including the winding unit 15 disposed further downstream of the transport direction A than the recording unit 12 and capable of winding the medium P, in which the detecting unit 8 is disposed further downstream of the transport direction A than the recording unit 12 as well as further upstream of the transport direction A than the winding unit 15.

According to the present aspect, the detecting unit 8 is disposed further downstream of the transport direction A than the recording unit 12 as well as further upstream of the transport direction A than the winding unit 15. Thus, since skewing of the transported medium P can be effectively detected before winding of the medium P, failure to wind the medium P such as winding the medium P slantwise can be effectively prevented.

The recording apparatus 1 in a seventh aspect of the invention, according to any one of the first to sixth aspects, is characterized in that the length L1*a* in the intersecting direction B of the frictional force exerting unit 61 is greater than or equal to the length of transport of the medium P in the intersecting direction B on the transport path of the medium P.

The expression the length of transport of the medium P in the intersecting direction B on the transport path of the medium P" means the maximum length of the medium P expected to be employed in the intersecting direction B.

According to the present aspect, the length L1*a* of the frictional force exerting unit 61 in the intersecting direction B is greater than or equal to the length of transport of the medium P in the intersecting direction B on the transport path of the medium P, that is, greater than or equal to the length L2 of the medium P in the intersecting direction B. Thus, the frictional force exerting unit 61 can come into contact with the medium P in both of the widthwise end portions of the medium P, and skewing of the transported medium P can be effectively prevented.

The recording apparatus 1 in an eighth aspect of the invention, according to any one of the first to seventh aspects, is characterized by further including, as the frictional force exerting unit 61, the first frictional force exerting unit 61*e* exerting frictional force increasing from one side to the other side of the medium P in the intersecting direction B on the medium P and the second frictional force exerting unit 61*f* exerting frictional force decreasing from the one side to the other side on the medium P, in which the control unit 23 is capable of controlling the contact of the first frictional force exerting unit 61*e* and the second frictional force exerting unit 61*f* with the medium P on the basis of the detection result from the detecting unit 8.

According to the present aspect, the recording apparatus 1 includes the first frictional force exerting unit 61*e* exerting frictional force increasing from the one side to the other side on the medium P and the second frictional force exerting unit 61*f* exerting frictional force decreasing from the one side to the other side on the medium P. In addition, the control unit 23 can control the contact of the first frictional force exerting unit 61*e* and the second frictional force exerting unit 61*f* with the medium P on the basis of the detection result from the detecting unit 8. Thus, since the frictional force exerting unit 61 having different frictional force distributions in the intersecting direction B can be selected from the first frictional force exerting unit 61*e* and the second frictional force exerting unit 61*f* depending on the direction of the medium P skewed during transport thereof, skewing of the transported medium P can be prevented.

A recording method in a ninth aspect of the invention for the recording apparatus 1 including the transporting unit 9 capable of transporting the medium P, the detecting unit 8 capable of detecting the transport direction A in which the medium P is transported by the transporting unit 9, and the recording unit 12 capable of performing recording on the medium P transported by the transporting unit 9 is characterized by including controlling the contact of the frictional force exerting unit 61, which is capable of coming into contact with and separating from the side 17 of the medium P opposite to the recording side 16 on which recording is performed by the recording unit 12 and is capable of coming into contact with at least a part of the opposite side 17 of the medium P in the intersecting direction B intersecting with the transport direction A to exert frictional force on the medium P differently in the intersecting direction B when the medium P is transported by the transporting unit 9, with the medium P on the basis of the detection result from the detecting unit 8 and transporting the medium P to perform recording on the medium P.

According to the present aspect, the contact of the frictional force exerting unit 61, which is capable of coming into contact with and separating from the opposite side 17 of the medium P and is capable of coming into contact with at least a part of the opposite side 17 of the medium P in the intersecting direction B to exert frictional force on the medium P differently in the intersecting direction B when the medium P is transported by the transporting unit 9, with the medium P is controlled on the basis of the detection result from the detecting unit 8, and the medium P is transported to perform recording on the medium P. Thus, recording can be performed while skewing of the transported medium P is prevented without damaging the recording side 16 of the medium P.

The recording apparatus 1 in a tenth aspect of the invention is characterized by including the transporting unit 9 capable of transporting the medium P, the detecting unit 8 capable of detecting the transport direction A in which the medium P is transported by the transporting unit 9, the recording unit 12 capable of performing recording on the medium P transported by the transporting unit 9, the rotating object 62 including the contactable region R2 (R3) having a coefficient of friction against the medium P increasing from one side to the other side of the rotating object 62 in the intersecting direction B intersecting with the transport direction A as well as the contactable region R3 (R2) having a coefficient of friction against the medium P decreasing from the one side to the other side and capable of coming into contact with the side 17 of the medium P opposite to the recording side 16 on which recording is performed by the recording unit 12 while including a rotating shaft in the intersecting direction B, and the control unit 23 controlling the rotating object 62 on the basis of the detection result from the detecting unit 8 to set the contact region of the rotating object 62 coming into contact with the medium P.

According to the present aspect, the recording apparatus 1 includes the rotating object 62 including the contactable region R2 (R3) having a coefficient of friction against the medium P increasing from one side to the other side of the rotating object 62 in the intersecting direction B as well as the contactable region R3 (R2) having a coefficient of friction against the medium P decreasing from the one side to the other side and capable of coming into contact with the side 17 of the medium P opposite to the recording side 16. In addition, the recording apparatus 1 includes the control unit 23 controlling the rotating object 62 on the basis of the detection result from the detecting unit 8 to set the contact region of the rotating object 62 coming into contact with the medium P. Thus, since the contact regions of the rotating object 62 can be set to have different frictional force distributions depending on the direction of the medium P skewed during transport thereof, skewing of the transported medium P can be prevented without damaging the recording side 16 of the medium P.

The expression "capable of detecting the transport direction A" includes the meaning that, for example, detecting the positions of the end portions of the medium P in the intersecting direction B intersecting with the transport direction A or detecting the speed of transport of the medium P can result in the detection of the transport direction A.

The recording apparatus 1 in an eleventh aspect of the invention is characterized by including the transporting unit 9 capable of transporting the medium P, the detecting unit 8 capable of detecting the transport direction A in which the medium P is transported by the transporting unit 9, the recording unit 12 capable of performing recording on the medium P transported by the transporting unit 9, the rotating object 62 including the contactable region R2 (R3) of which the area of contact with the medium P increases from one side to the other side of the rotating object 62 in the intersecting direction B intersecting with the transport direction A as well as the contactable region R3 (R2) of which the area of contact with the medium P decreases from the one side to the other side and capable of coming into contact with the side 17 of the medium P opposite to the recording side 16 on which recording is performed by the recording unit 12 while including a rotating shaft in the intersecting direction B, and the control unit 23 controlling the rotating object 62 on the basis of the detection result from the detecting unit 8 to set the contact region of the rotating object 62 coming into contact with the medium P.

According to the present aspect, the recording apparatus 1 includes the rotating object 62 including the contactable region R2 (R3) of which the area of contact with the medium P increases from one side to the other side of the rotating object 62 in the intersecting direction B as well as the contactable region R3 (R2) of which the area of contact with the medium P decreases from the one side to the other side and capable of coming into contact with the side 17 of the medium P opposite to the recording side 16. In addition, the recording apparatus 1 includes the control unit 23 controlling the rotating object 62 on the basis of the detection result from the detecting unit 8 to set the contact region of the rotating object 62 coming into contact with the medium P. Thus, since the contact regions of the rotating object 62 can be set to have different frictional force distributions depending on the direction of the medium P skewed during transport thereof, skewing of the transported medium P can be prevented without damaging the recording side 16 of the medium P.

The recording apparatus 1 in a twelfth aspect of the invention, according to the first or second aspect, is characterized by further including the moving object 11 moving together with the recording unit 12 in the intersecting direction B, in which the detecting unit 8 is disposed in the moving object 11.

According to the present aspect, the detecting unit 8 is disposed in the moving object 11 moving together with the recording unit 12 in the intersecting direction B. Thus, since the detecting unit 8 can simply detect the end portions of the medium P in the intersecting direction B, skewing of the transported medium P can be prevented in a case where a continuous medium such as the roll-shaped medium P is employed as the medium P.

The recording apparatus 1 in a thirteenth aspect of the invention, according to the first or second aspect, is characterized in that the detecting unit 8 is disposed further upstream of the transport direction A than the recording unit 12.

According to the present aspect, the detecting unit 8 is disposed further upstream of the transport direction A than the recording unit 12.

Thus, since skewing of the transported medium P can be detected before recording, it is possible to prevent degradation of the quality of an image recorded on the medium P.

The recording apparatus 1 in a fourteenth aspect of the invention, according to the first or second aspect, is characterized by further including the winding unit 15 disposed further downstream of the transport direction A than the recording unit 12 and capable of winding the medium P, in which the detecting unit 8 is disposed further downstream of the transport direction A than the recording unit 12 as well as further upstream of the transport direction A than the winding unit 15.

According to the present aspect, the detecting unit 8 is disposed further downstream of the transport direction A than the recording unit 12 as well as further upstream of the transport direction A than the winding unit 15. Thus, since skewing of the transported medium P can be effectively detected before winding of the medium P, failure to wind the medium P such as winding the medium P slantwise can be effectively prevented.

The recording apparatus 1 in a fifteenth aspect of the invention, according to any one of the first to fifth aspects, is characterized in that the length L1*b* in the intersecting direction B of the rotating object 62 is greater than or equal to the length of transport of the medium P in the intersecting direction B on the transport path of the medium P.

The expression the length of transport of the medium P in the intersecting direction B on the transport path of the medium P" means the maximum length of the medium P expected to be employed in the intersecting direction B.

According to the present aspect, the length L1*b* of the rotating object 62 in the intersecting direction B is greater than or equal to the length of transport of the medium P in the intersecting direction B on the transport path of the medium P, that is, greater than or equal to the length L2 of the medium P in the intersecting direction B. Thus, the rotating object 62 can securely come into contact with the medium P across the width direction of the medium P and can effectively prevent skewing of the transported medium P.

The recording apparatus 1 in a sixteenth aspect of the invention, according to any one of the first to sixth aspects, is characterized by further including the tensile force generating unit 10*b* disposed further downstream of the transport direction A from the recording unit 12 and coming into contact with the medium P at the contact unit 13 across the intersecting direction B to exert tensile force on the medium P, in which the rotating object 62 is disposed in the contact unit 13.

According to the present aspect, the rotating object 62 is disposed in the contact unit 13 in the tensile force generating unit 10*b* disposed further downstream of the transport direction A than the recording unit 12 and coming into contact with the medium P at the contact unit 13 across the intersecting direction B to exert tensile force on the medium P. Thus, the tensile force generating unit 10*b* having the function of preventing skewing of the transported medium P as well can reduce the necessity of configuring the rotating object 62 separately from the tensile force generating unit 10*b*.

The meaning of the expression "coming into contact with the medium P at the contact unit 13 across the intersecting direction B" includes a case where a part of the tensile force generating unit 10*b* does not come into contact with the medium P in the intersecting direction B.

A recording method in a seventeenth aspect of the invention for the recording apparatus 1 including the transporting unit 9 capable of transporting the medium P, the detecting unit 8 capable of detecting the transport direction A in which the medium P is transported by the transporting unit 9, and the recording unit 12 capable of performing recording on the medium P transported by the transporting unit 9 is characterized by including setting the contact region of the rotating object 62, which includes the contactable region R2 (R3) having a coefficient of friction against the medium P increasing from one side to the other side of the rotating object 62 in the intersecting direction B intersecting with the transport direction A as well as the contactable region R3 (R2) having a coefficient of friction against the medium P decreasing from the one side to the other side and is capable of coming into contact with the side 17 of the medium P opposite to the recording side 16 on which recording is performed by the recording unit 12 while including a rotating shaft in the intersecting direction B, on the basis of the detection result from the detecting unit 8 and transporting the medium P to perform recording on the medium P.

According to the present aspect, the contact region of the rotating object 62, which includes the contactable region R2 (R3) having a coefficient of friction against the medium P increasing from one side to the other side of the rotating object 62 in the intersecting direction B as well as the contactable region R3 (R2) having a coefficient of friction against the medium P decreasing from the one side to the other side and is capable of coming into contact with the side 17 of the medium P opposite to the recording side 16, is set on the basis of the detection result from the detecting unit 8, and the medium P is transported to perform recording on the medium P. Thus, recording can be performed while skewing of the transported medium P is prevented without damaging the recording side 16 of the medium P.

A recording method in an eighteenth aspect of the invention for the recording apparatus 1 including the transporting unit 9 capable of transporting the medium P, the detecting unit 8 capable of detecting the transport direction A in which the medium P is transported by the transporting unit 9, and the recording unit 12 capable of performing recording on the medium P transported by the transporting unit 9 is characterized by including setting the contact region of the rotating object 62, which includes the contactable region R2 (R3) of which the area of contact with the medium P increases from one side to the other side of the rotating object 62 in the intersecting direction B intersecting with the transport direction A as well as the contactable region R3 (R2) of which the area of contact with the medium P decreases from the one side to the other side and which is capable of coming into contact with the side 17 of the medium P opposite to the recording side 16 on which recording is performed by the recording unit 12 while including a rotating shaft in the intersecting direction B, on the basis of the detection result from the detecting unit 8 and transporting the medium P to perform recording on the medium P.

According to the present aspect, the contact region of the rotating object 62, which includes the contactable region R2 (R3) of which the area of contact with the medium P increases from one side to the other side of the rotating object 62 in the intersecting direction B as well as the contactable region R3 (R2) of which the area of contact with the medium P decreases from the one side to the other side and is capable of coming into contact with the side 17 of the medium P opposite to the recording side 16, is set on the basis of the detection result from the detecting unit 8, and the medium P is transported to perform recording on the medium P. Thus, recording can be performed while skewing of the transported medium P is prevented without damaging the recording side 16 of the medium P.

The entire disclosure of Japanese Patent Application No.: 2014-250621, filed Dec. 11, 2014 and 2014-250628, filed Dec. 11, 2014 are expressly incorporated by reference herein.

What is claimed is:

1. A recording apparatus comprising:

a transporting unit that is capable of transporting a medium;

a detecting unit that is capable of detecting a transport direction in which the medium is transported by the transporting unit;

a recording unit that is capable of performing recording on the medium transported by the transporting unit;

a frictional force exerting unit that is capable of coming into contact with and separating from a side of the medium opposite to a recording side on which recording is performed by the recording unit and is capable of coming into contact with at least a part of the opposite side of the medium to exert frictional force on the medium when the medium is transported by the transporting unit; and a control unit that controls the contact of the frictional force exerting unit with the medium on the basis of a detection result from the detecting unit; and a winding unit that is disposed further downstream of the transport direction than the recording unit and is capable of winding the medium, wherein the detecting unit is disposed further downstream of the transport direction than the recording unit as well as further upstream of the transport direction than the winding unit.

2. The recording apparatus according to claim 1, wherein the frictional force exerting unit is an extending member that extends in the intersecting direction, and the control unit is capable of controlling a region of the frictional force exerting unit coming into contact with the medium in the intersecting direction by changing the angle between the medium and the frictional force exerting unit in the intersecting direction viewed from the transport direction.

3. The recording apparatus according to claim 2, wherein the frictional force exerting unit is an extending member that includes an arc face convex toward the opposite side when viewed from the transport direction.

4. The recording apparatus according to claim 1, wherein the length of the frictional force exerting unit in the intersecting direction is greater than or equal to the length of transport of the medium in the intersecting direction on a transport path of the medium.

5. The recording apparatus according to claim 1, further comprising:

as the frictional force exerting unit, a first frictional force exerting unit that exerts frictional force increasing from one side to the other side of the medium in the intersecting direction on the medium and a second frictional force exerting unit that exerts frictional force decreasing from the one side to the other side on the medium, wherein the control unit is capable of controlling contact of the first frictional force exerting unit and the second frictional force exerting unit with the medium on the basis of the detection result from the detecting unit.

6. A recording method for a recording apparatus including a transporting unit capable of transporting a medium, a detecting unit capable of detecting a transport direction in which the medium is transported by the transporting unit, a recording unit capable of performing recording on the medium transported by the transporting unit, and a winding unit that is disposed further downstream of the transport direction than the recording unit and is capable of winding the medium, wherein the detecting unit is disposed further downstream of the transport direction than the recording unit as well as further upstream of the transport direction than the winding unit, the method comprising:

controlling contact of a frictional force exerting unit with the medium on the basis of a detection result from the detecting unit, the frictional force exerting unit being capable of coming into contact with and separating from a side of the medium opposite to a recording side on which recording is performed by the recording unit and being capable of coming into contact with at least a part of the opposite side of the medium to exert frictional force on the medium when the medium is transported by the transporting unit, and transporting the medium to perform recording on the medium.

* * * * *